United States Patent [19]

Yamashita et al.

[11] Patent Number: 4,768,363

[45] Date of Patent: Sep. 6, 1988

[54] METHOD OF LEVELLING TWO-LAYERED CLAD METAL SHEET

[75] Inventors: Michio Yamashita; Hiroshi Yoshida; Toru Sasaki; Hideo Abe; Tsuneo Nagamine; Norio Takashima; Hideki Watanabe, all of Chiba; Shuji Watanabe, Tokyo, all of Japan

[73] Assignee: Kawasaki Steel Corporation, Hyogo, Japan

[21] Appl. No.: 887,033

[22] PCT Filed: Nov. 28, 1985

[86] PCT No.: PCT/JP85/00658

§ 371 Date: Jul. 2, 1986

§ 102(e) Date: Jul. 2, 1986

[87] PCT Pub. No.: WO86/03435

PCT Pub. Date: Jun. 19, 1986

[30] Foreign Application Priority Data

| | | | |
|---|---|---|---|
| Dec. 3, 1984 | [JP] | Japan | 59-254181 |
| Jan. 7, 1985 | [JP] | Japan | 60-000110 |
| Jan. 8, 1985 | [JP] | Japan | 60-000401 |
| Jan. 8, 1985 | [JP] | Japan | 60-000402 |
| Jul. 11, 1985 | [JP] | Japan | 60-151325 |
| Oct. 31, 1985 | [JP] | Japan | 60-242921 |

[51] Int. Cl.[4] ..... B21D 37/16; B21D 1/02; B21D 3/02

[52] U.S. Cl. ..... 72/13; 72/128; 72/160

[58] Field of Search ..... 72/8, 9, 12, 13, 128, 72/160, 200, 201, 364, 365, 366

[56] References Cited

U.S. PATENT DOCUMENTS

| | | | |
|---|---|---|---|
| 3,347,076 | 10/1967 | Noda et al. | 72/201 |
| 3,613,418 | 10/1971 | Nara et al. | 72/8 |

FOREIGN PATENT DOCUMENTS

| | | | |
|---|---|---|---|
| 52-19165 | 5/1977 | Japan . | |
| 56-80324 | 7/1981 | Japan . | |
| 816612 | 3/1981 | U.S.S.R. | 72/201 |

*Primary Examiner*—E. Michael Combs

*Attorney, Agent, or Firm*—Koda and Androlia

[57] ABSTRACT

A method for preventing the camber of a two-layered clad metal sheet having a base layer and a covering layer of different metals which exhibit different amounts of thermal contraction. The method comprises developing a temperature difference Δ T expressed by the following formula between the base layer and the covering layer during a hot levelling, by providing a greater cooling effect before or during levelling to the layer which exhibits the greater thermal contraction than to the layer which exhibits the smaller thermal contraction:

$$\Delta T = f(\Delta\alpha, \bar{\alpha}, a, To)$$

where, $\Delta\alpha$: the difference in thermal expansion coefficient between both metals a: the clad ratio (ratio of covering layer thickness to total sheet thickness)

To: hot leveller inlet temperature (°C.)

$\bar{\alpha}$: mean thermal expansion coefficient of both metals.

Since the layer which exhibits a greater thermal contraction is forcibly cooled before or during a hot levelling adequately and by a required amount, the clad metal sheet does not exhibit any substantial camber after cooled down to the room temperature.

7 Claims, 16 Drawing Sheets

METHOD OF LEVELLING TWO-LAYERED CLAD METAL SHEET

TECHNICAL FIELD

The present invention relates to a method of levelling a two-layered clad metal sheet.

BACKGROUND ART

Two-layered clad metal sheets are known which have a base layer of a carbon steel clad with a covering layer of, for example, stainless steel, cupro nickel, etc.. The production of such a two-layered clad metal sheet encounters the following problem. Two layers of different metals have different amounts of thermal contraction when the clad sheet is cooled after levelling by a hot leveller. Therefore the clad metal sheet after cooled down to the room temperature exhibits a camber in such a manner that the metal layer of the greater thermal expansion coefficient is disposed on the radially inner side of the clad metal sheet.

More specifically, in ordinary process for rolling thick metal sheets, the hot sheet after the rolling is levelled by a leveller in order to remove any shape defect in the sheet, e.g., center buckle, edge wave, breadthwise camber and lengthwise camber. The hot-levelled sheet is then cooled on a cooling table. Any shape defect which is generated during the cooling is also levelled by a leveller after the cooling, whereby a flat sheet is obtained.

In the case of a two-layered clad steel sheet composed of a base sheet 1A and a covering layer 1B which have different values of thermal expasion coefficient, a breadthwise camber, which is much greater than that experienced by ordinary steel sheet, is caused during the cooling after the hot levelling, as shown in FIG. 22. In case of the two-layered clad sheet, a difference in the value of the thermal expansion coefficient exists between the base layer which is, for example, a carbon steel and a covering layer which is, for example, a stainless steel, as will be seen from FIG. 23. In consequence, two layers of the clad sheet exhibit different amounts of thermal contraction during the cooling down to the room temperature after the hot levelling, resulting in a large breadthwise camber. The amount y of the camber is maximized when the clad sheet has been cooled down to the room temperature. In the case of a two-layered clad sheet composed of a base layer of a carbon steel and a covering layer of a stainless steel, the camber amount y reaches 300 to 400 mm, although this amount y varies depending on the conditions such as the levelling temperature, sheet thickness, sheet width and the clad ratio, i.e., the ratio of the thickness of the covering layer to the total thickness of the clad sheet.

This heavy camber after the hot levelling causes the following inconveniences.

(a) It is difficult to convey the sheet by table rollers, when the sheet has a heavy camber.

(b) The sheet has to experience an impractically large number of passes during a subsequent cold levelling.

(c) If the camber is extremely heavy, it is practically impossible to level the sheet by an ordinary cold leveller.

The present inventors have already proposed, in Japanese Patent Unexamined Patent No. 42122/1984, a method for levelling a two-layered clad sheet, which has been successfully carried out.

According to this proposed method, the layer having the greater thermal expansion coefficient is forcibly cooled before or during the hot levelling so as to create a temperature difference between two layers, and the sheet is levelled in this state, so that the clad sheet shows only a small camber when cooled to the room temperature.

More specifically, referring to FIG. 23, the covering layer exhibits a greater amount of thermal contraction than that of the base layer. Thus, the base layer exhibits a thermal contraction $\Delta\epsilon c$ when cooled down from a temperature Tc to the room temperature, whereas the covering layer exhibits the same thermal contraction $\Delta\epsilon s$ when cooled to the room temperature from a temperature Ts which is below the temperature Tc. Thus, if the covering layer is cooled down forcibly to the temperature Ts while the base layer is maintained at the temperature Tc and the sheet is levelled in this state, both layers exhibit the same amount of thermal contraction when they are cooled down to the room temperature, thus the generation of the camber after cooling is prevented substantially.

According to this method, a negative camber is generated in the clad sheet immediately after the hot levelling, as a result of a uniformalization of the temperature, i.e., the transfer of heat from the base layer to the covering layer. However, this negative camber is gradually decreased as the temperature is lowered, and a substantially flat state is obtained when the sheet has been cooled down to the room temperature. In consequence the load in the subsequent cold levelling is reduced or, in some cases, eliminates the necessity for the cold levelling.

Actually, however, there are a variety of types of two-layered clad metal sheets requiring this method. These clad metal sheets have different values of thickness, width, clad ratio and the material of the covering layer. This means that the above-mentioned proposed method cannot equally apply to the variety of clad metal sheets.

Moreover the above-mentioned proposed method encounters the following problems.

(a) The clad metal sheet immediately after the hot levelling exhibits a negative large camber. This undesirably impedes the convey of the clad metal sheet by table rollers, with a result that the production efficiency is impaired seriously.

(b) In order to forcibly cool the layer of the greater thermal contraction amount during the hot levelling, it is necessary that the hot leveller must equip a cooling device. The size and the capacity of the cooling device, however, must be small in the hot leveller. Thus, it is very difficult to attain the desired temperature difference (Tc - Ts) between two layers, particularly when the amount of camber is large, as in the case where the levelling temperature the clad ratio and the sheet thickness are high, high and thin respectively.

(c) The steel sheet has a greater tendency of shape defect such as camber than ordinary steel sheet consisting of a single layer, not only during the finish rolling but also during the subsequent convey. Therefore, a longer time is wasted until the hot levelling is commenced, so that the temperature, at which the hot levelling is started, tends to be lowered undesirably. In such a case, the levelling temperature may further come down as a result of the forcible cooling conducted during the hot levelling. Consequently, as the yield stress of the base layer becomes high, it is difficult to impart the desired plastic deformation by the hot levelling. In such a case, the positive camber, that the layer of the greater thermal contraction constitutes the inner side, appears immediately after the hot levelling, and this camber further grows as the sheet is cooled down to the room temperature.

Accordingly, an object of the invention is to provide a method which prevents the camber of a two-layered clad metal sheet at the room temperature.

DISCLOSURE OF THE INVENTION

According to a first aspect of the invetion, there is provided a method for preventing the camber of a two-layered clad metal sheet having a base layer and a covering layer of different metals which exhibit different amounts of thermal contraction, the method comprising: developing a temperature difference $\Delta T$ expressed by the following formula between the base layer and the covering layer during a hot levelling, by providing a greater cooling effect before or during the levelling to the layer which exhibits the greater thermal contraction than to the layer which exhibits the smaller thermal contraction:

$$\Delta T = f(\Delta\alpha, \overline{\alpha}, a, To)$$

where, $\Delta\alpha$: the difference in thermal expansion coefficient between both metals a: the clad ratio (ratio of covering layer thickness to total sheet thickness)

To: hot leveller inlet temperature (°C.)

$\overline{\alpha}$: mean thermal expansion coefficient of both metals.

According to a second aspect of the invention, there is provided a method for preventing the camber of a two-layered clad metal sheet having a base layer and a covering layer of different metals which exhibit different amounts of thermal contraction, wherein a greater cooling effect is imparted to the layer which exhibits the greater thermal contraction than to the layer which exhibits the smaller thermal contraction by upper and lower water-cooling means before or during a hot levelling, the method comprising: computing the temperature difference during the levelling between the upper and lower surfaces of the clad metal sheet necessary for preventing the final camber of the clad metal sheet when the sheet is cooled to the room temperature; and controlling the density of the cooling water applied by the water-cooling means and the velocity at which the clad metal sheet passes through the hot leveller, in such a manner that the actual temperature difference measured by upper and lower thermometers disposed in the hot leveller coincides with the computed temperature difference.

According to a third aspect of the invention, there is provided a method for preventing the camber of a two-layered clad metal sheet having a base layer and a covering layer of different metals which exhibit different amounts of thermal contraction, wherein a greater cooling effect is imparted to the layer which exhibits the greater thermal contraction than to the layer which exhibits the smaller thermal contraction by upper and lower water-cooling means before or during a hot levelling, the method comprising: computing the temperature difference during the levelling between the upper and lower surfaces of the clad metal sheet necessary for preventing the final camber of the clad metal sheet when the sheet is cooled to the room temperature; and controlling the density of the cooling water between the upper and lower water-cooling means and the velocity at which the clad metal sheet passes through the hot leveller, in such a manner that the actual temperature difference measured by upper and lower thermometers disposed in the hot leveller coincides with the computed temperature difference; predicting the expected final amount of camber at the room temperature from information obtained from the clad metal sheet at the outlet side of the hot leveller after a uniformalization of the temperature; correcting the result of computation of the temperature difference of the next clad metal in accordance with the predicted final amount of camber.

According to a fourth aspect of the invention, there is provided a method for preventing the camber of a two-layered clad metal sheet having a base layer and a covering layer of different metals which exhibit different amounts of thermal contraction, wherein a greater cooling effect is imparted to the layer which exhibits the greater thermal contraction than to the layer which exhibits the smaller thermal contraction by upper and lower water-cooling means before or during a hot levelling, the method comprising: setting the difference in the density of the cooling water between the upper and lower water-cooling means and the velocity of the sheet in the hot leveller which are necessary for preventing the final camber of the clad metal sheet when the sheet is cooled to the room temperature; and controlling the upper and lower water-cooling means and the sheet velocity in accordance with the setting values.

According to a fifth aspect of the invention, there is provided a method for preventing the camber of a two-layered clad metal sheet having a base layer and a covering layer of different metals which exhibit different amounts of thermal contraction, wherein a greater cooling effect is imparted to the layer which exhibits the greater thermal contraction than to the layer which exhibits the smaller thermal contraction by upper and lower water-cooling means before or during a hot levelling, the method comprising: setting the difference in the density of the cooling water between the upper and lower water-cooling means and the velocity of the sheet in the hot leveller which are necessary for preventing the final camber of the clad metal sheet when the sheet is cooled to the room temperature; controlling the upper and lower water-cooling means and the sheet velocity in accordance with the setting values; predicting the expected final amount of camber at the room temperature from information obtained from the clad metal sheet at the outlet side of the hot leveller after a uniformalization of the temperature; correcting the result of computation of the density of the cooling water and the sheet velocity of the next clad metal in accordance with the predicted final amount of camber.

According to a sixth aspect of the invention, there is provided a method for preventing the camber of a two-layered clad metal sheet composed of a base layer and a covering layer of different metals having different values of thermal expansion coefficient, the method comprising: forcibly cooling, before or during hot levelling, the layer which exhibits the greater thermal contraction so as to develop a predetermined temperature difference during the levelling between the upper and lower surfaces of the clad metal sheet; and further forcibly cooling, after the hot levelling, the layer so as to decrease a negative camber which occurs due to a uniformalization of the temperature at the outlet side of the leveller.

According to a seventh aspect of the invention, there is provided a method for preventing the camber of a two-layered clad metal sheet composed of a base layer and a covering layer of different metals having different values of thermal expansion coefficient, the method comprising: heating the layer which exhibits the smaller thermal contraction before or during hot levelling, while forcibly cooling the layer which exhibits a greater thermal contraction before or during the hot levelling so as to develop a predetermined temperature difference between the upper and lower surfaces of the clad metal sheet during the hot levelling.

THE BEST MODE FOR CARRYING OUT THE INVENTION

Figure 1:
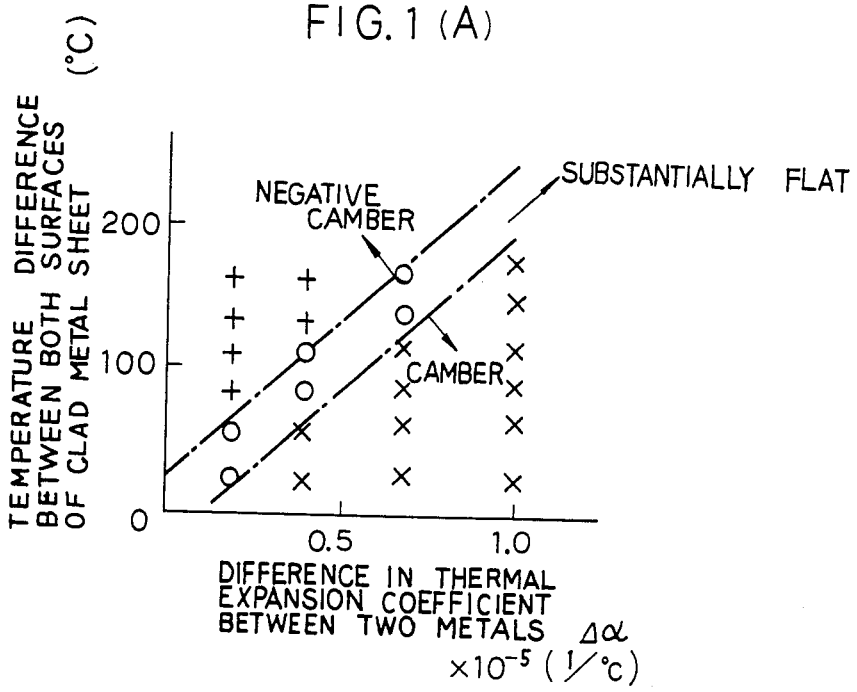
FIG. 1A is a diagram showing how the difference in the thermal expansion coefficient between two metals, temperature difference between the upper and lower surfaces of the clad sheet and the final camber are related to one another.
FIG. 1B is a diagram showing how the mean thermal expansion coefficient of the two metals, temperature difference between the upper and lower surfaces of the clad sheet and the final camber are related to one another.
FIG. 1C is a diagram showing how the clad ratio, temperature difference between the upper and lower surfaces of the clad sheet and the final camber are related to one another.
FIG. 1D is a diagram showing how the hot-leveller inlet temperature, the temperature difference between the upper and lower surfaces of the clad sheet and the final camber are relates to one another.
Figure 1:
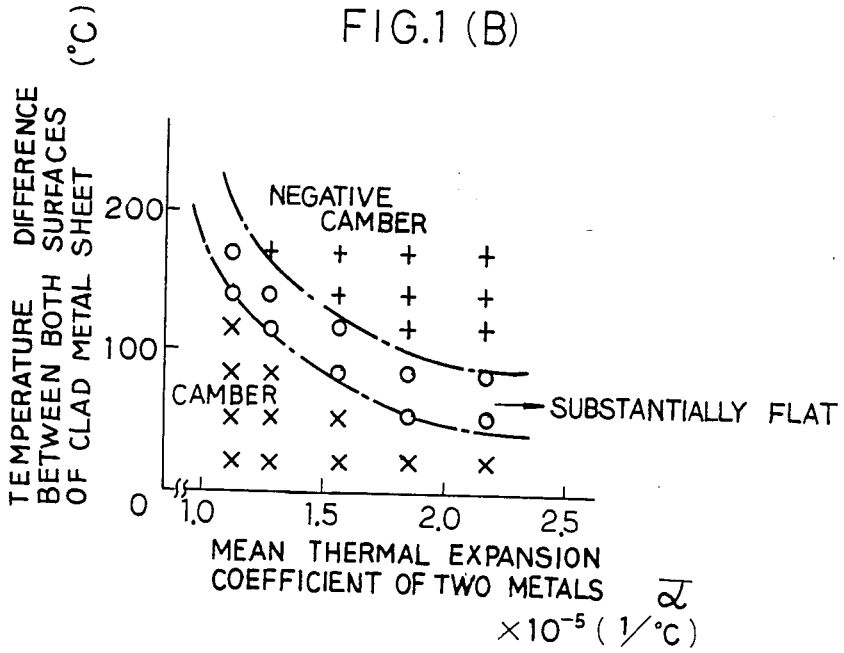
Figure 1:
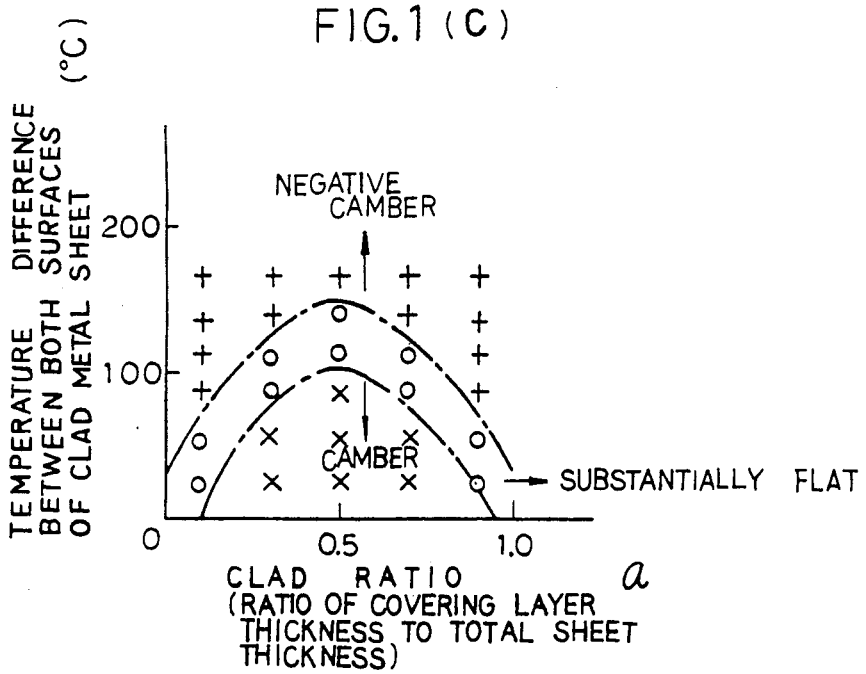
Figure 1:
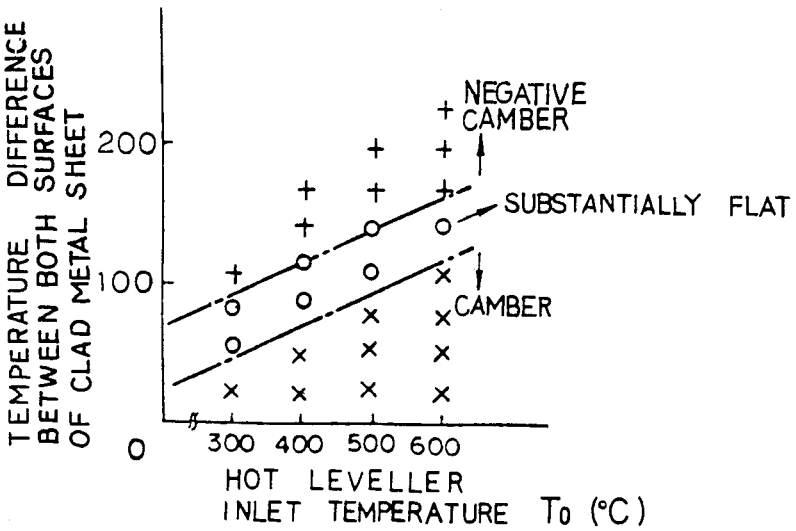

Preferred embodiments of the invention will be described hereinunder with reference to the accompanying drawings.

[First Embodiment]

The first levelling method in accordance with the invention will be explained hereinunder.

A two-layered clad steel sheet with a base layer of a carbon steel and a covering layer constituted by a stainless steel, having a total thickness of 25 mm and a width of 2850 mm, was used as a representative of the two-layered clad metal sheet to which the invention pertains. Four factors were selected with the clad steel sheet:

namely, the difference $\Delta\alpha$ in the thermal expansion coefficient between the base layer of the carbon steel and the covering layer of the stainless steel, mean thermal expansion coefficient $\overline{\alpha}$ of two metals, clad ratio a, i.e., the ratio of the thickness of the covering layer to the total sheet thickness, and the sheet temperature To at the hot leveller inlet. A plurality of clad sheets of the above-stated specification were prepared and subjected to hot levelling in which various temperature difference values between the upper and lower surfaces of the clad sheet were imparted by means of a water-cooling type cooling device, by varying one of the factors while maintaining other factors at respective standard values. The results of the hot levelling are shown in FIGS. 1A to 1D. The standard conditions were: $\Delta\alpha=0.4\times10^{-5}$ (1/C°), $\overline{\alpha}=1.6\times10^{-5}$ (1/C°), a=0.3 and To=400° C.

In these Figures, marks "X" represents the presence of positive camber with the layer having greater thermal expansion coefficient constituting the inner side at the room temperature, "+" represent the presence of negative camber with the layer of greater thermal expansion coefficient constituting the outer side at the room temperature, and "o" indicates that the clad is flat at the room temperature.

From FIGS. 1A to 1D, it will be seen that, in order that the final camber of the clad sheet is reduced to zero at the room temperature, i.e., the substantially flat state of the clad sheet, it is necessary that the temperature difference $\Delta T$ applied between the upper and lower surfaces of the clad sheet during the hot levelling meets the condition of the following function:

$$\Delta T=f(\Delta\alpha, \overline{\alpha}, a, To) \quad (1)$$

where, $\Delta\alpha$ represents the difference in the thermal expansion coefficient between both metals, $\overline{\alpha}$ represents the mean thermal expansion coefficient of both metals; a represents the clad ratio (ratio of covering layer thickness to total sheet thickness), and To represents the hot leveller inlet temperature.

Using the data shown in FIGS. 1A to 1D, the function (1) shown above can be reformed as follows:

| | | |
|---|---|---|
| $\Delta T$ | $= K_1\,\Delta\alpha$ | (temperature difference is proportional to difference in thermal expansion coeficient between two metals) |
| | $= K_2\,1/\overline{\alpha}$ | (temperature difference is inverse proportional to mean thermal expansion coefficient of two metals) |
| | $= K_3\,a(1-a)$ | (temperature difference is given as quadratic function of cladding ratio) |
| | $= K_4\,To$ | (temperature difference is proportional to the hot leveller inlet temperature) |

where, $K_1$ to $K_4$ are proportional constants. Therefore, the temperature difference is expressed by the following formula (2):

$$\Delta T=K_o\cdot\Delta\alpha/\overline{\alpha}\cdot a(1-a)\cdot T_o \quad (2)$$

From the data shown in FIGS. 1A to 1D, it is understood that the constant Ko preferably ranges between 4 and 6, in order that the clad steel sheet is flat, i.e., the camber is zero, at the room temperature. However, the first embodiment of the levelling method of the invention provides an appreciable effect as compared with the case where the first embodiment is not conducted, provided that the constant Ko ranges between 1 and 11. The condition expressed by the formula (2) is an example of the formula which is composed of respective factors. Thus, the first embodiment of the invention can include the temperature control conducted in other formula which is composed of these factors.

The data shown in FIGS. 1A to 1D have been obtained when the clad sheet composed of a base layer of a carbon steel and a covering layer of a stainless steel is used as the two-layered clad metal sheet. The inventors have confirmed, however, the tendency explained heretofore observed with this clad sheet apply generally to other ordinary two-layered clad metal sheets.

Figure 8:
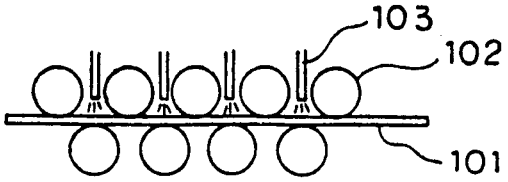
FIG. 8 is a schematic illustration of a levelling apparatus used in a first embodiment of the invention.

In FIG. 8, a reference numeral 101 denotes the clad steel sheet, 102 denotes a hot leveller and 103 denotes a cooling device.

A description will be made hereinunder as to the result of experimental levelling conducted in accordance with the first embodiment of the invention, in comparson with the result of the levellig in accordance with the conventional levelling method. The experiment was conducted on three types of clad steel sheet having a carbon steel base layer and a stainless steel covering layer with a total sheet thickness and sheet width of 20 mm and 3000 mm, respectively. The three types of sheets had different clad ratios of 10%, 30% and 50%, respectively. In the conventional method, the clad sheets were hot-levelled by the apparatus shown in FIG. 8 such that a constant temperature difference is developed between the upper and lower of the clad sheet. On the other hand, the levelling method of the invention was carried out while controlling the temperature difference in accordance with the formula (2) which is one of the forms derived from the function of the formula (1). After the experimental levelling, the amounts of camber were compared between the clad sheets levelled by the conventional method and the clad sheets levelled in accordance with the invention.

More specifically, in the conventional levelling method, the clad sheets were fed into the hot leveller at a hot leveller inlet temperature of 700° C., and the hot levelling was conducted while cooling the clad sheet from one side of thereof such that the levelling is finished to obtain a flat state of the clad sheets with the stainless steel layer and the carbon steel layer maintained at 500° C. and 600° C., respectively, for all of the three types of clad sheets having the clad ratios of 10%, 30% and 50%.

Figure 9A:
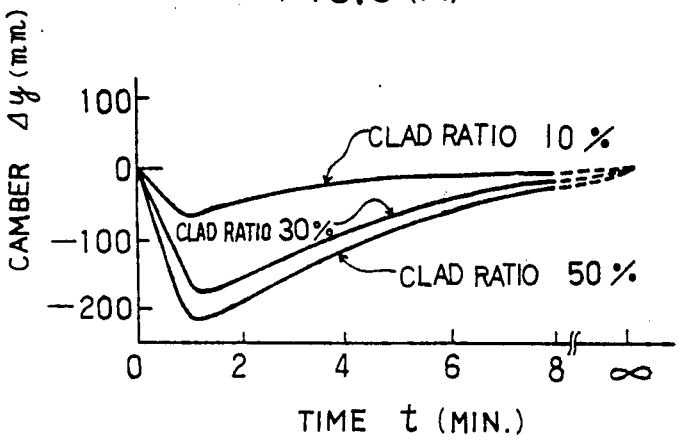
FIG. 9A is a diagram showing the change in the amount of camber in relation to the time after the hot levelling in accordance with the first embodiment of the invention.
Figure 9B:
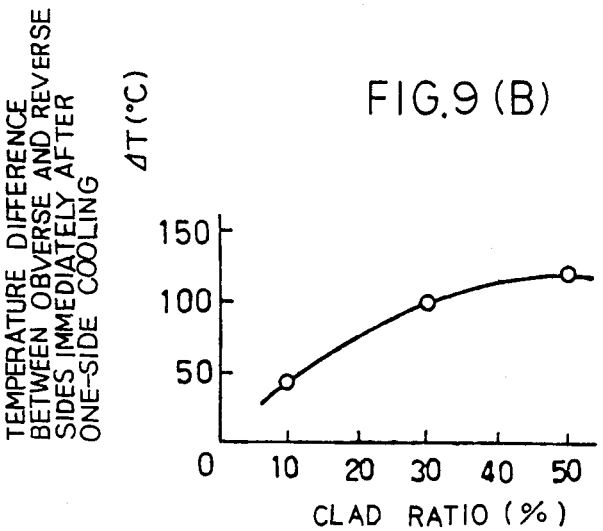
FIG. 9B is a diagram showing the temperature difference between the upper and the lower surfaces of the clad sheet after the levelling in accordance with the first embodiment of the invention.
Figure 10A:
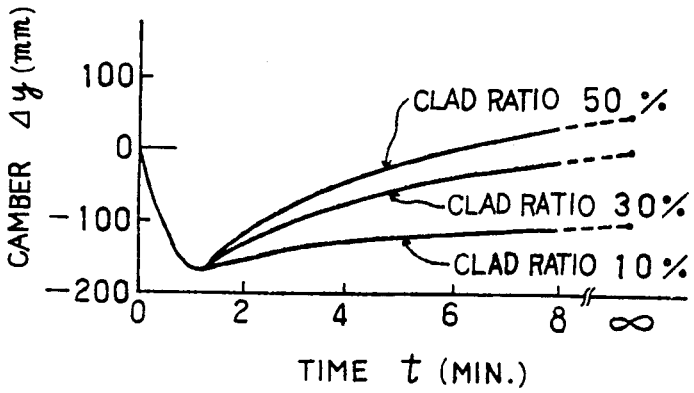
FIG. 10A is a diagram showing the change in the amount of camber in relation to time after the levelling in accordance with a conventional method.
Figure 10B:
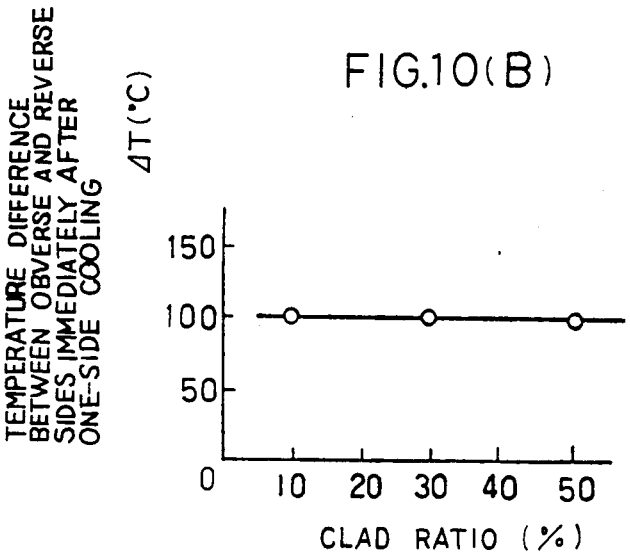
FIG. 10B is a diagram showing the temperature difference between the upper side and the lower surfaces of the clad sheet after the levelling in accordance with the conventional method.

On the other hand, in the levelling method in accordance with the invention, the temperature difference between the upper and lower surfaces of the clad sheet was controlled in accordance with the formula (2) mentioned above: namely, the clad sheet of the 10% clad ratio was hot-levelled to the flat state while the stainless steel layer and the carbon steel layer were held at 580° C. and 620° C., respectively. In the case of the clad sheet of 30% clad ratio, the hot levelling was finished at the stainless steel layer temperature and the carbon steel layer temperature of 500° C. and 600° C., respectively. Finally, the clad sheet of 50% clad ratio was finished at the stainless steel layer temperature and carbon steel layer temperature of 460° C. and 580° C., respectively. FIGS. 9A and 9B show the temperature difference between the upper and lower surfaces of the clad sheets immediately after the levelling in accordance with the invention, and the change in the amount of camber of the clad sheets after the levelling in accordance with the invention. Similar data obtained with the clad sheets levelled by the conventional method are shown in FIGS. 10A and 10B.

Three types of clad sheet levelled by the conventional levelling method showed almost the same amount of camber of about 180 mm at a moment about 1 minutes after the completion of the levelling as a result of the uniformalization of the temperature, due to the fact that a constant temperature difference was maintained between the upper and lower surfaces of the clad sheet during the levelling. However, these three types of sheets having different clad ratios exhibit different amounts of camber as they are further cooled. Namely, altough the clad sheet having the clad ratio of 30% exhibits a final camber of substantially zero at the room temperature, the clad sheet of the 10% clad ratio showed a large negative camber of 100 mm, because the negative camber imparted by the forcible cooling during the levelling cannot be completely extinguished. On the other hand, the clad sheet having 50% clad ratio showed a positive camber of 35 mm, due to the large difference in the amount of thermal expansion between both layers.

In contrast, three types of clad sheet levelled in accordance with the invention showed different amounts of camber at the moment about 1 minute after the levelling as a result of the uniformalization of the temperature, i.e., the transfer of heat from the base layer, due to the fact that these sheets were levelled with temperature differences between the upper and lower surfaces. Namely, the clad sheets having the clad ratios of 10%, 30% and 50% showed, respectively, the negative cambers of 70 mm, 180 mm and 210 mm, at the above-mentioned moment. However, as the sheets were further cooled, the amounts of camber converged and the camber was substantially prevented finally, regardless of the clad ratio.

Thus, in the first embodiment of the levelling method of the invention, the temperature difference between the upper and lower surfaces of the clad sheet is controlled in accordance with the condition expressed by the formula (2) mentioned before or during the levelling, so that a substantially flat state of the clad sheet is finally obtained for various values of factors such as the sheet thickness, clad ratio, material of the covering layer and the temperature at which the levelling is commenced. This in turn eliminates the necessity for cold levelling which heretofore has to be conducted after cooling in the conventional process, for all types of two-layered clad metal sheet.

It will be clear to those skilled in the art that the first embodiment of the levelling method of the invention can theoretically apply to all types of two-layered clad metal sheet having a variety of combinations of metals of different thermal expansion coefficients, not only to the clad steel sheet mentioned hereinbefore.

As has been described, according to the first embodiment of the levelling method of the invention, the temperature difference which is to be developed across the thickness of the two-layered clad metal sheet is determined taking into account the factors which affect the camber of the clad metal sheet, so that the camber is prevented at the room temperature without fail. In other words, in the first embodiment of the invention described hereinbefore, the metal layer which exhibits greater amount of thermal contraction is cooled optimumly such as to ensure the flat state of the two-layered clad metal sheet at the room temperature.

[Second Embodiments]

The second and third levelling methods in accordance with the invention will be described hereinunder.

Figure 2:
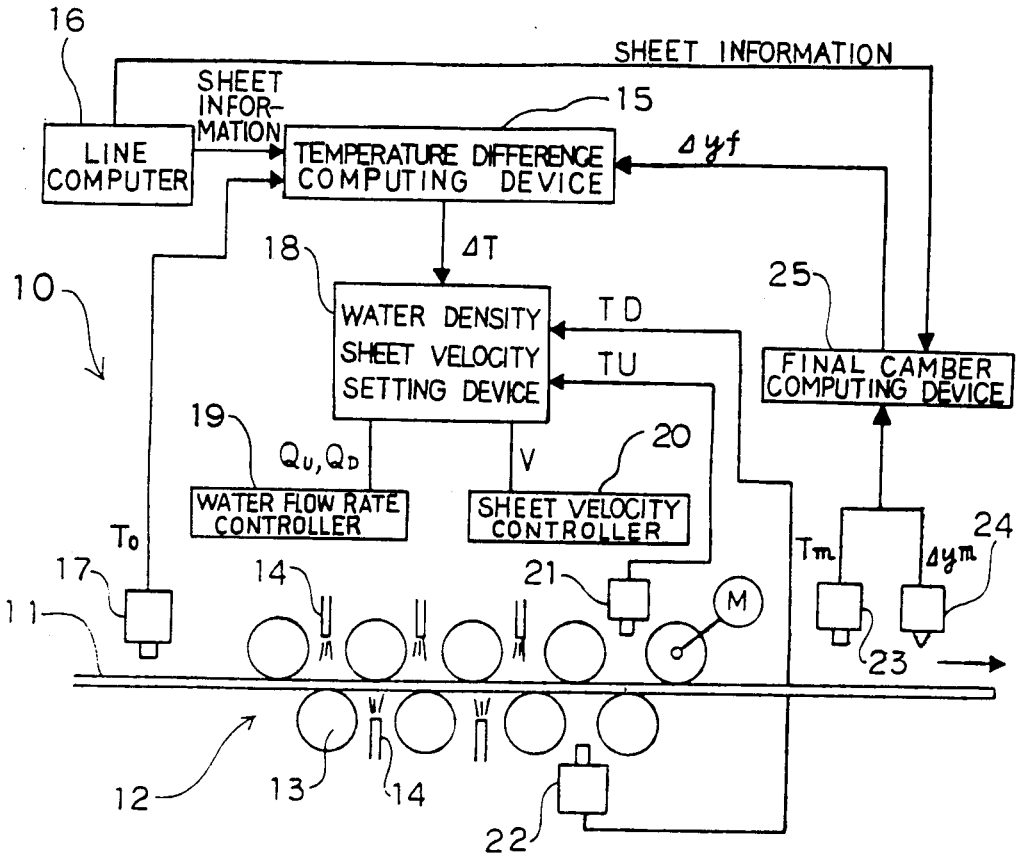
FIG. 2 is a block diagram of a control system for controlling a levelling apparatus which is used in the second and the third embodiments of the invention.

FIG. 2 schematically shows a levelling system 10, as well as a block diagram of the control system for the levelling system 10, suitable for use in carrying out the second and third embodiments of the invention.

A two-layered clad steel sheet 11 is composed of a base layer of a metal having, for example, a comparatively small thermal contraction amount (small thermal expansion coefficient), e.g., a carbon steel, and a covering layer having a comparatively large thermal contraction amount (large thermal expansion coefficient), e.g., a stainless steel. The clad sheet 11 is rolled by a rolling mill, hot-levelled by a leveller 12 and then conveyed to a subsequent step of a process by means of a table roller.

The hot leveller 12 has a plurality of upper and lower hot leveller rolls 13 which are arranged in a staggered manner, and cooling headers 14 arranged on the upper and lower sides of the path of the levelled clad sheet at positions between adjacent upper leveller rollers and between adjacent lower leveller rollers. The cooling headers 14 are designed and arranged such that the covering layer having the greater thermal expansion coefficient is cooled more strongly than the base layer having smaller thermal expansion coefficient, so as to maintain, during the hot levelling, a temperature difference necessary for preventing the camber of the clad sheet 11 after the latter is cooled to the room temperature.

If the hot levelling is conducted with the covering layer of the clad sheet directed downwardly, therefore, the cooling heads 14 should be arranged such as to provide a greater cooling effect to the lower side of the clad sheet than to the upper side of the same.

In the embodiments shown in FIG. 2, since the covering layer having the greater thermal expansion coefficient is directed upwardly, the cooling headers are arranged to provide a greater cooling effect to the upper side of the clad sheet than to the lower side thereof. Thus, in the embodiments shown in FIG. 2, the cooling headers 14 may be arranged only on the upper side of the path of the clad sheet, such as to face the covering layer having the greater thermal expansion coefficient.

That is, the levelling may be conducted by using only the cooling headers disposed on the upper side of the path of the clad sheet, while the cooling headers disposed under the path of the clad sheet is not used or omitted. Similarly, when the levelling is conducted with the covering layer having the greater thermal expansion coefficient directed downwardly, the cooling headers may be arranged only at the lower side of the path of the clad sheet.

The levelling system 10 has a temperature difference computing device 15 which is adapted to compute the temperature difference $\Delta T$ between the upper and lower surface of the clad sheet 11 necessary for preventing the camber of the clad sheet 11 at the room temperature, in accordance with the formula (1), practically the formula (2) mentioned before, from various data stored in a line computer 16, such as the size of the clad sheet 11, difference in thermal expansion coefficient between the base layer and the covering layer, mean thermal expansion coefficient $\overline{\alpha}$ of both metals, clad ratio a and so forth, as well as the temperature To of the clad sheet 11 at the inlet side of the hot leveller 12 as measured by a thermometer 17.

Figure 3:
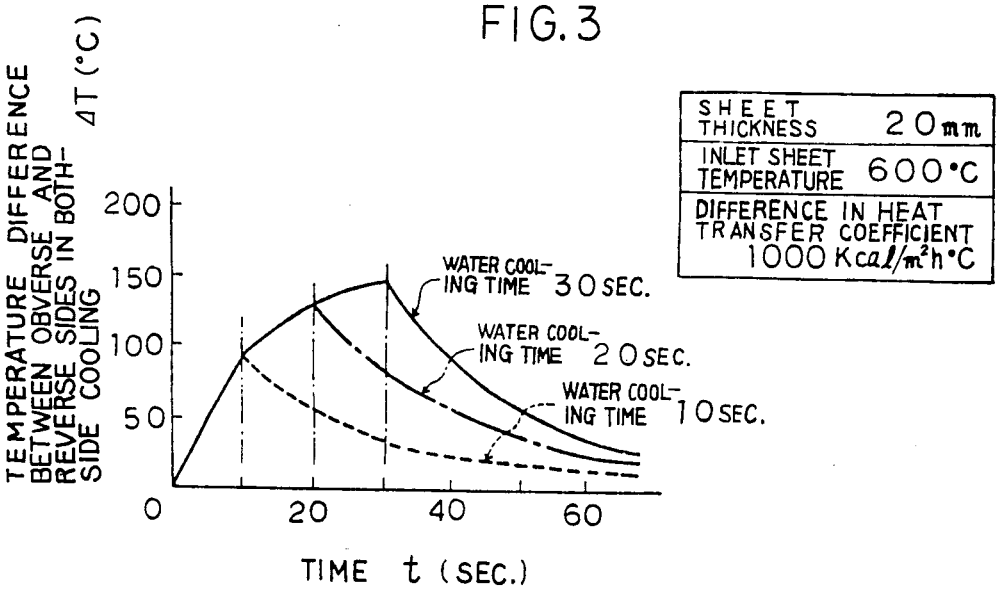
FIG. 3 is a diagram showing the relationship between the water-cooling time and the temperature difference between the upper and lower surfaces of the clad sheet.
Figure 4:
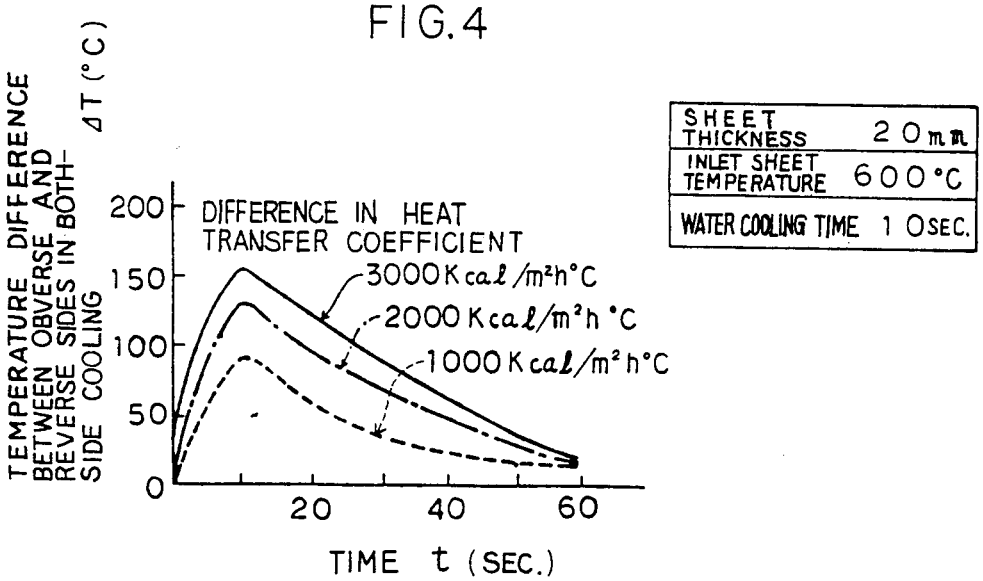
FIG. 4 is a diagram showing how the difference in the heat transfer coefficient between the upper and lower surfaces of the clad sheet is related to the temperature difference between the upper and the lower sides of the clad sheet.

The application of the computed temperature difference ΔT to the steel sheet 11 is practically conducted by adjusting the period of the water cooling on the steel sheet 11, as well as the adjustment of the difference in the heat transfer coefficient between the upper and lower surfaces. The influences of the water cooling period and the difference in the heat transfer coefficient on the temperature difference ΔT are shown by diagrams in FIGS. 3 and 4, respectively. Referring to FIG. 3, the temperature difference between the upper and lower surfaces of the clad sheet 11 is increased as the time elapses. This suggests that the temperature difference between the upper and lower surfaces of the clad sheet 11 is controllable by adjusting the period of the water cooling. On the other hand, FIG. 4 shows that the greater the difference in the heat transfer coefficient between both sides of the clad sheet, the higher the speed of increase of the temperature difference between both sides of the clad sheet. This suggests that the temperature difference between the upper and lower surfaces of the clad sheet is controllable also by means of the difference in the heat transfer coefficient between the upper and lower surfaces of the clad sheet. The adjustment of the water cooling period and the difference in the heat transfer coefficient in the actual hot-leveller 12 requires a control of the following two factors:

(a) To control the velocity of the clad sheet in the hot leveller 12 such as to vary the period of stay of each point on the clad sheet 11 in the cooling region, thus varying the water cooling period.

(b) To adjust the flow rate of water while taking into account the area of the water cooling region, so as to vary the density of the cooling water spray on both sides of the clad sheet, i.e., to vary the amout of water by which each point on the steel sheet is contacted per unit time and unit area, thus varying the difference in the heat transfer coefficient between the upper and lower surfaces of the clad sheet.

Figure 6:
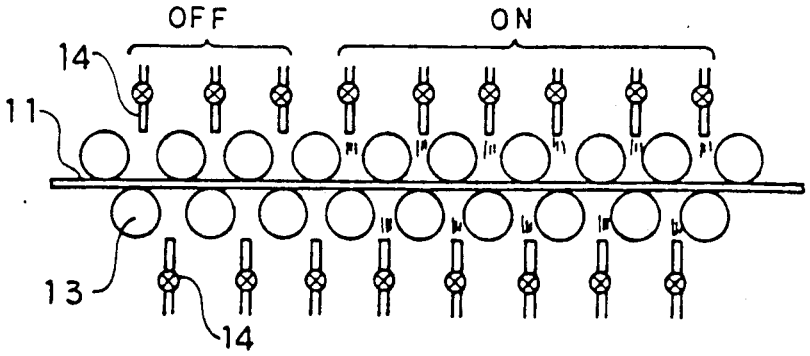
FIG. 6 is a schematic illustration of another levelling apparatus.

Namely, from the practical point of view, the controls (a) and (b) mentioned above are rather easy to conduct, as the measures for controlling the temperature difference ΔT between the upper and lower surfaces of the clad sheet. These two controls (a) and (b), however, are not exclusive. For instance, the cooling period can be varied by varying the effective length of the cooling region, by arranging the levelling device to have a considerable length as shown in FIG. 6 and effecting an on-off control of the cooling water nozzles which are arranged along the length of the levelling device. The cooling headers disposed at the lower side of the path of the clad sheet in the arrangement shown in FIG. 6 may be omitted, as in the case of the arrangement shown in FIG. 2. The difference in the heat transfer coeficient between the upper and lower surfaces of the clad sheet can be varied also by changing other factors such as the size of the nozzle ports of the cooling water nozzles and the state of the cooling medium applied, e.g., change from mist cooling to spray cooling and further to laminar cooling. Such alternative measures, however, requires a significant change or modification in the equipment. Other possible measures such as an adjustment of the cooling water temperature or a forcible heating of the layer having smaller thermal contraction amount also require a substantial variation in the equipment.

In the levelling system 10 in the described embodiments, therefore, the temperature difference computing device 15 computes the temperature difference ΔT between the upper and lower surfaces of the clad sheet, and delivers instruction signals to a setting device 18 of the water density and sheet velocity, the instruction signals representing the cooling water densities, i.e., flow rates QU and QD which are to be provided by the upper and lower cooling headers, as well as the velocity V of the clad sheet through the hot leveller 12, necessary for developing the desired temperature difference ΔT between the upper and lower surfaces of the clad sheet 11. To this end, the setting device of the water density and sheet velocity beforehands stores, in the form of numerical data, table or chart, the relationships between the temperature difference ΔT and the water flow rates QU, QD and the sheet velocity V, for the clad steel sheets of various sizes, materials and clad ratios, so that the setting device 19 can sets the water flow rates QU and QD, as well as the velocity V, necesary for imparting the desired temperature difference between the upper and lower surfaces of the clad steel sheet 11 to be levelled.

In response to the instruction signals given by the setting device 18, the levelling system 10 operates a cooling water flow rate controller 19 and a sheet velocity controller 20, thereby controlling the flow rates of the cooling water from the upper and lower cooling headers and the velocity at which the clad sheet passes through the hot leveller 12.

The levelling system 10 also has an upper thermometer 21 and a lower thermometer 22 which are disposed in the hot leveller 12 and adapted to measure the temperatures TU and TD of the obverse and reverse sides of the clad steel sheet 11, respectively. The thermometers 21 and 22 deliver signals representing the temperatures TU and TD to the setting device 18. Upon receipt of these signals, the setting device 18 performs a feedback control in such a manner that the measured temperature difference (TU−TD) between the upper and lower surfaces of the clad steel sheet coincides with the command temperature difference ΔT computed by the device 15 for computing the temperature difference, through controlling the operation of the water flow rate controller 19 which in turn controls the water flow rates from the upper and lower cooling headers, and controlling also the operation of the velocity controller 20 which controls the velocity at which the clad sheet 11 passes through the hot leveller 12.

The levelling system 10 may be arranged such that, after the completion of the levelling, it measures the final amount of the camber of the clad sheet 11 at the room temperature, and suitably varies the amounts of control of the cooling water flow rates and/or the sheet velocity in accordance with the measured final value of the camber, thus allowing the succeeding clad sheet to be controlled at higher accuracy. Actually, however, such a feedback control is impractical because of too long time required for the clad sheet to be cooled down to the room temperature. On the other hand, the present inventors have confirmed that there are fixed relationships between the final amount of the camber and the clad sheet temperature and amount of camber of the clad sheet 11 at the outlet of the hot leveller 12, i.e., in the state immediately after the uniformalization of the temperature.

Figure 5:
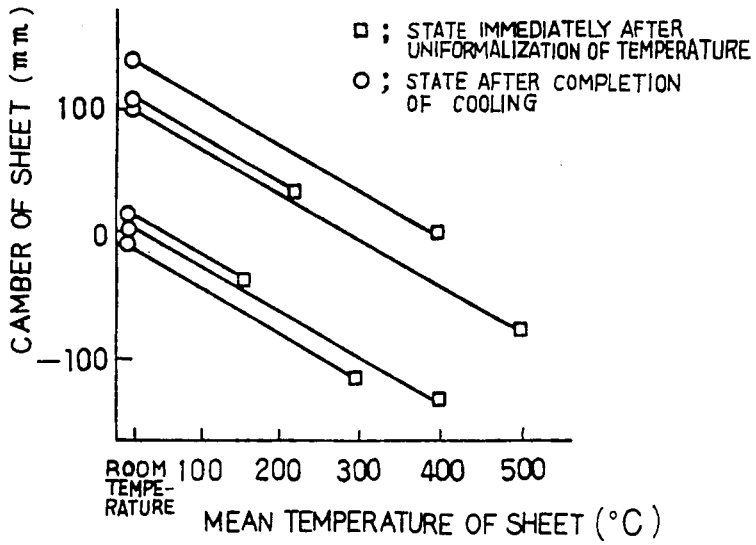
FIG. 5 is a diagram showing the relationship between the mean temperature of the clad sheet and the amount of camber in the state immediately after a uniformalization of the temperature.

FIG. 5 shows the relationship between the amount of camber and the mean temperature of the clad sheet having a total sheet thickness of 20 mm, sheet breadth of 3000 mm and the clad ratio of 30%, as observed after the temperature uniformalization. As will be seen from this Figure, the same material exhibits the same gradient of change of the camber in relation to temperature. This means that the final amount of the camber at the room temperature can be predicted provided that the amount of camber and the temperature after the temperature uniformalization are measured.

In view of the above, the levelling system 10 incorporates an outlet thermometer 23 and a camber meter 24 disposed at the outlet side of the hot leveller 12, so as to measure the temperature Tm and the amount Δym of the camber of the clad steel sheet 11 after the temperature uiformalization, and to deliver the thus measured temperature Tm and the amount Δym of the clad steel sheet to a final camber computing device 25. The final camber computing device 25 computes the final amount Δyf of the clad steel sheet at the room temperature, using the measured temperature Tm and the amount Δym of the camber, as well as the information derived from the line computer, such as the sheet thickness, sheet breadth, clading ratio and the materials of the base and covering layers. The result of this computation can be fed back to the temperature difference computing device 15. The temperature difference computing device 15 is adapted to correct the result of computation of the temperature difference ΔT in such a manner that the computed final amount Δyf of the camber becomes zero. By virtue of this function, the levelling system 10 can perform the optimum control of the levelling operation, thus reducing the final amount of the camber at the room temperature substantially to zero.

The correction of the temperature difference ΔT computed by the temperature difference computing device 15 is conducted, for exampe, in accordance with the following manner. The final amount of camber computed on condition that the temperature difference ΔT is zero, i.e., on condition that the levelling method of the invention is not carried out, is represented by yo. On the other hand, the actual final amount of camber, obtained when the temperature difference is set at TR so as to prevent the final amount of camber, is represented by yR. That is, the reduction in the final amount of camber computed on the basis of the temperature difference is yo, while the actual reduction obtained with the same temperature difference is yo−yR. Therefore, a correction coefficient KT is obtained from the following formula (3).

$$KT=yo/(yo-yR) \quad (3)$$

By multiplying the temperature difference ΔT computed for the next clad sheet by the correction coefficient KT, therefore, it is possible to effect a more adequate levelling for the next clad sheet.

The method of the invention, however, does not essentially requires the correction of the computed temperature difference ΔT by the final camber computing device 25.

As will be understood from the foregoing description, according to the second and the third embodiments of the invention, it is possible to obtain a flat clad sheet having no camber after the cooling, regardless of the factors such as the sheet thickness, clad ratio, material of the covering layer and the temperature at which the levelling is commenced. This in turn eliminates the necessity for the cold levelling which heretofore has been necessarily employed following the hot levelling, for all types of two-layered clad steel sheet.

It will be understood by those skilled in the art that the described second and third embodiments are theoretically applicable not only to the described clad steel sheet but also to any types of two-layered clad metal sheet having various combinations of metals of different thermal expansion coefficients.

[Third Embodiments]

The fourth and fifth levelling methods in accordance with the invention will be described hereinunder.

Figure 7:
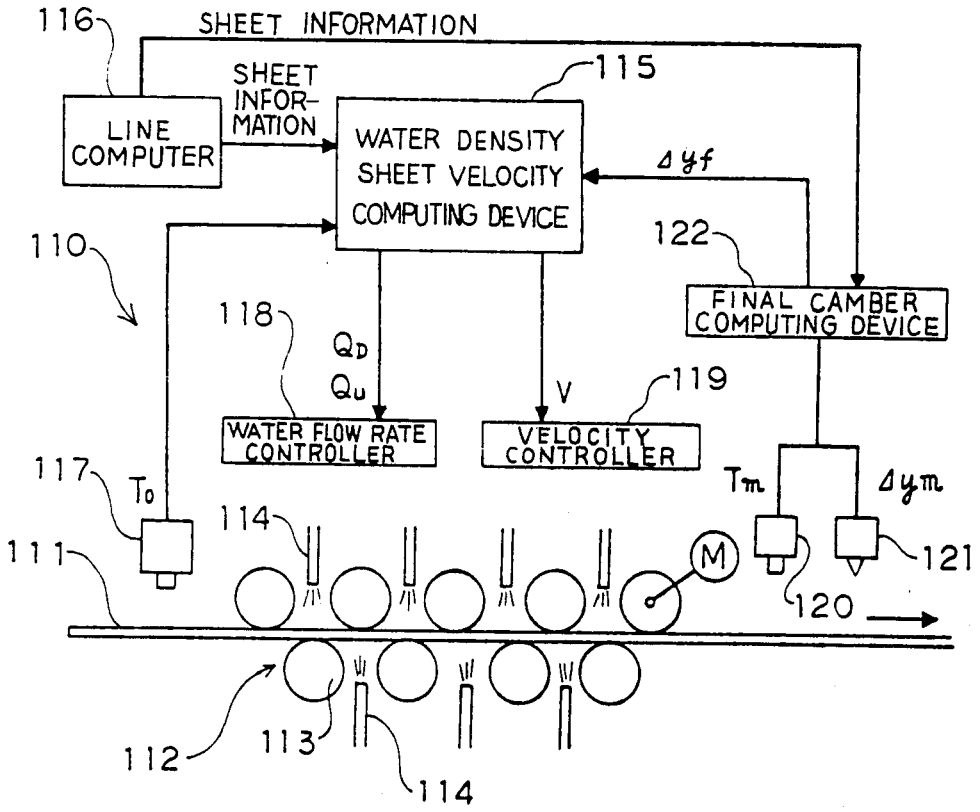
FIG. 7 is a block diagram of a control system for a levelling apparatus which is used in the fourth and the fifth embodiments of the invention.

FIG. 7 schematically shows a levelling system 110, as well as a block diagram of the control system for the levelling system 110, suitable for use in carrying out the fourth and fifth embodiments of the invention.

A two-layered clad steel sheet 111 is composed of a base layer of a metal having, for example, a comparatively small thermal contraction amount (small thermal expansion coefficient), e.g., a carbon steel, and a covering layer having a comparatively large thermal contraction amount (large thermal expansion coefficient), e.g., a stainless steel. The clad sheet 111 is rolled by a rolling mill, hot-levelled by a hot leveller 112 and then conveyed to a subsequent step of a process by means of table rollers.

The hot leveller 112 has a plurality of upper and lower hot leveller rolls 113 which are arranged in a staggered manner, and cooling headers 114 arranged on the upper and lower sides of the path of the levelled clad sheet at positions between adjacent upper leveller rollers and between adjacent lower leveller rollers. The cooling headers 114 are designed and arranged such that the covering layer having the greater thermal expansion coefficient is cooled more strongly than the base layer having smaller thermal expansion coefficient, so as to maintain, during the hot levelling, a temperature difference necessary for preventing the camber of the clad sheet 111 after the latter is cooled to the room temperature. In the embodiments shown in FIG. 7, since the covering layer of the stainless steel having the greater thermal expansion coefficient is directed upwardly, the cooling headers are arranged to provide a greater cooling effect to the upper side of the clad sheet than to the lower side thereof.

Thus, in the embodiments shown in FIG. 7, the cooling headers 114 may be arranged only on the upper side of the path of the clad sheet, such as to face the covering layer having the greater thermal expansion coefficient. That is, the levelling may be conducted by using only the cooling headers disposed on the upper side of the path of the clad sheet, while the cooling headers disposed under the path of the clad sheet is not used or omitted. Similarly, when the levelling is conducted with the covering layer having the greater thermal expansion coefficient directed downwardly, the cooling headers may be arranged only at the lower side of the path of the clad sheet.

The levelling system 110 has a device 115 for setting water density and sheet velocity which stores, in the form of formula or chart, the difference in the water density between the upper and lower cooling headers 114 and the velocity of the clad sheet in the hot leveller 112 which are necessary for preventing the final camber of the clad sheet 111 at the room temperature, for a variety of values of factors such as the size, materials, and clad ratio of the steel sheet 111, as well as the hot leveller inlet temperature.

Namely, the levelling system 110 computes the temperature difference ΔT between the upper and lower surfaces of the clad sheet 111 necessary for preventing the camber of the clad sheet 111 at the room temperature, in accordance with the formula (1), practically the formula (2) mentioned before, from various data such as the size, materials and the clad ratio of the clad steel sheet 111, as well as the temperature of the clad sheet 111 at the inlet side of the hot leveller 112. The levelling system 110 also stores, within the setting device 115, the difference in the water density between the upper and lower cooling headers 114, i.e., between the flow rates QU and QD, as well as the sheet velocity V in the hot leveller 112, necessary for imparting the temperature difference ΔT.

Thus, the setting device 115 sets the water flow rates QU and QD from the upper and lower water headers 114 and the sheet velocity V in the hot leveller 112 which are necessary for preventing the final camber of the clad sheet 111 at the room temperature, in accordance with the data from the line computer 116 such as the size of the clad sheet 111, materials of the base and covering layers and the clad ratio, as well as the temperature To of the clad sheet 111 at the inlet side of the hot leveller 112 as measured by the thermometer 117.

The levelling system 110 of the described embodiments, therefore, delivers instruction signals to a water density controller 118 and to a sheet velocity controller 119, instruction signals representing the cooling water densities, i.e., flow rates QU and QD which are to be provided by the upper and lower cooling headers and the velocity V of the clad sheet through the hot leveller 112, in accordance with the values set by the setting device 115, thereby controlling the water flow rates QU, QD and the sheet velocity V.

The levelling system 110 may be arranged such that, after the completion of the levelling, it measures the final amount of the camber of the clad sheet 111 at the room temperature, and suitably varies the amounts of control of the cooling water flow rates and/or the sheet velocity in accordance with the measured final value of the camber, thus allowing the succeeding clad sheet to be controlled at higher accuracy. Actually, however, such a feedback control is impractical because of too long time required for the clad sheet to be cooled down to the room temperature. On the other hand, the present inventors have confirmed that there are fixed relationships between the final amount of the camber and the clad sheet temperature and the amount of camber of the clad sheet 111 at the outlet of the hot leveller 112, i.e., in the state immediately after the temperature uniformalization, as explained before in connection with FIG. 5.

In view of the above, the levelling system 110 incorporates an outlet thermometer 120 and a camber meter 121 disposed at the outlet side of the hot leveller 112, so as to measure the temperature Tm and the amount Δym of the camber of the clad steel sheet 111 after the temperature uniformalization, and to deliver the thus measured temperature Tm and the amount Δym of the clad steel sheet to a final camber computing device 112. The final camber computing device 112 computes the final amount Δyf of the clad steel sheet at the room temperature, using the measured temperature Tm and the amount Δym of the camber, as well as the information derived from the line computer, such as the sheet thickness, sheet breadth, clad ratio and the materials of the base and covering layers. The result of this computation can be fed back to the setting device 115. The device 115 is adapted to correct the result of computation of the water flow rates Q and the sheet velocity V in such a manner that the computed final amount Δyf of the camber becomes zero. By virtue of this function, the levelling system 110 can perform the optimum control of the levelling operation, thus reducing the final amount of the camber at the room temperature substantially to zero.

The correction of the water flow rates QU, QD from the upper and lower cooling headers and the sheet velocity V computed by the setting device 115 is conducted, for exampe, in accordance with the following manner.

Referring first to the water flow rates from the upper and lower cooling headers, the final amount of camber computed on condition that the difference in the water flow rate is zero, i.e., on condition that the levelling method of the invention is not carried out, i.e., QU=QD, is represented by yo. On the other hand, the actual final amount of camber, obtained when the water flow rate difference is set at ΔQR (=QUR−QDR) so as to prevent the final amount of camber, is represented by yR. That is, the reduction in the final amount of camber computed on the basis of the flow rate difference ΔQR is yo, while the actual reduction obtained with the same flow rate difference is yo−yR. Therefore, a correction coefficient KQ is obtained from the following formula (4).

$$KQ=yo/(yo-yR) \quad (4)$$

By multiplying the water flow rate difference ΔQ computed for the next clad sheet by the correction coefficient KQ, therefore, it is possible to effect a more adequate levelling for the next clad sheet.

Referring now to the sheet velocity V, the final amount of camber computed on condition that the levelling method of the invention is not carried out is represented by yo. On the other hand, the actual final amount of camber, obtained when the sheet velocity is set at VR so as to prevent the final amount of camber, is represented by yR. That is, the reduction in the final amount of camber computed on the basis of the sheet velocity VR is yo, while the actual reduction obtained with the same sheet velocity is yo−yR. Therefore, a correction coefficient KV is obtained from the following formula (5).

$$KV=(yo-yR)\ /\ yo \quad (5)$$

By multiplying the sheet velocity V computed for the next clad sheet by the correction coefficient KV, therefore, it is possible to effect a more adequate levelling for the next clad sheet.

The method of the invention, however, does not essentially requires the correction of the computed water flow rates QU, QD and the sheet velocity V by the final camber computing device 122.

In addition, the setting device 115 may be arranged such as to control either one of the water density and the sheet velocity, while maintaining the other constant.

A description will be made hereinunder as to the result of experimental levelling conducted in accordance with the first embodiment of the invention, in comparson with the result of the levellig in accordance with the conventional levelling method. The experiment was conducted on three types of clad steel sheet having a carbon steel base layer and a stainless steel covering layer having a total sheet thickness and sheet width of 20 mm and 3000 mm, respectively. The three types of sheets had different clad ratios of 10%, 30% and 50%, respectively. In the conventional method, the clad sheets were hot levelled by the apparatus shown in FIG. 7 while maintaining the cooling water density and the sheet velocity at constant levels. On the other hand, the levelling method of the invention was carried out while controlling the cooling water density and the sheet velocity. After the experimental levelling, the amounts of camber were compared between the clad sheets levelled by the conventional method and the clad sheets levelled in accordance with the invention.

More specifically, in the conventional levelling method, the clad sheets were fed into the hot leveller at a hot leveller inlet temperature of 700° C., and the hot levelling was conducted while maintaining the sheet velocity and the cooling water density at consant levels of 30 m/min and 700 l/m$^2$ min to obtain a flat state of the clad sheets for all of the three types of clad sheets having the clad ratios of 10%, 30% and 50%.

Figure 11:
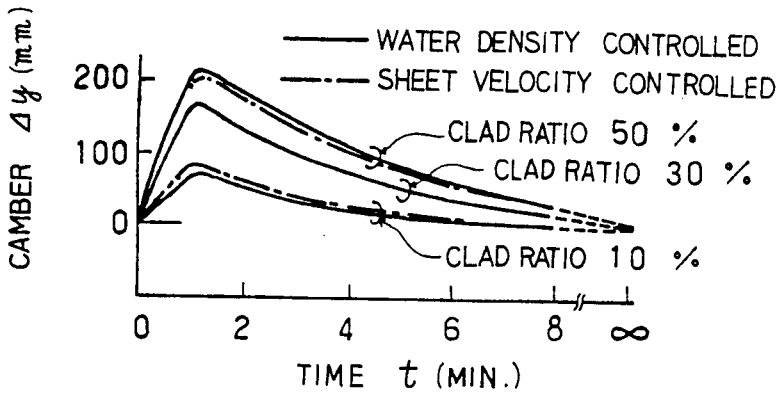
FIG. 11 is a diagram showing how the amount of camber is changed in relation to time, in the fourth and fifth embodiments of the invention.
Figure 12:
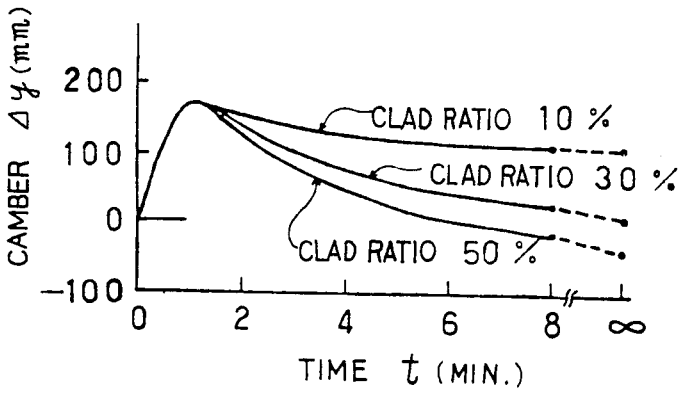
FIG. 12 is a diagram showing the change in the amount of camber in relation to time in the conventional levelling method.

On the other hand, in the levelling method in accordance with the invention, either one of the cooling water density and the sheet velocity was controlled while maintaining the other constant. In the first case where the sheet velocity was maintained at the constant level of 30 m/min, the cooling water density was changed such that the clad sheet of the 10% clad ratio was hot-levelled to the flat state by cooling at the cooling water density of 300 l/min. In the case of the clad sheet of 30% clad ratio, the hot levelling was conducted with the cooling water density of 700 l/m$^2$ min. Finally, the clad sheet of 50% clad ratio was finished with the cooling water density of 1000 l/m$^2$ min. In the case where only the sheet velocity was controlled, the cooling water density was maintained constant at 700 l/m$^2$ min and the sheet velocity was controlled at 60 m/sec for the clad sheet of 10% clad ratio, 30 m/min for the clad sheet of 30% clad ratio and 10 m/min for the clad sheet of 50% clad ratio, thus obtaining flat states of the clad sheets. FIG. 11 shows the change in the amounts of camber of the clad sheets after the levelling in accordance with the invention, while FIG. 12 shows the change in the amounts of camber after the levelling by the conventional method.

Three types of clad sheet levelled by the conventional levelling method showed almost the same amount of camber of about 180 mm after the completion of the levelling as a result of the temperature uniformalization, i.e., the transfer of heat from the base layer, due to the fact that a constant temperature difference was maintained between the upper and lower surfaces of the clad sheet during the levelling. However, these three types of sheets having different clad ratios exhibit different amounts of camber as they are further cooled. Namely, although the clad sheet having the clad ratio of 30% exhibits a final camber of substantially zero at the room temperature, the clad sheet of the 10% clad ratio showed a large negative camber of 100 mm, because the negative camber imparted by the forcible one-side cooling during the levelling cannot be completely extinguished. On the other hand, the clad sheet having 50% clad ratio showed a positive camber of 35 mm, due to the large difference in the amount of thermal expansion between both layers.

In contrast, three types of clad sheet levelled in accordance with the invention showed different amounts of camber after the levelling as a result of the temperature uniformalization, due to the fact that the cooling water density and the sheet velocity were controlled during the levelling. Namely, the clad sheet having the clad ratios of 10% showed negaive cambers of 70 mm (water density controlled) and 80 mm (sheet velocity controlled). The clad sheet of 30% clad ratio showed a negative camber of 180 mm in both cases. Finally, the clad sheet of 50% clad ratio showed negative cambers of 210 mm (water density controlled) and 200 mm (sheet velocity controlled). However, as the sheets were further cooled, the amounts of camber converged and the camber was substantially prevented finally, regardless of the clad ratio.

When the total clad sheet thickness is as small as 10 mm or below, although the control of the temperature difference between the upper and lower surfaces of the clad sheet can be conducted satisfactorily by the control of the cooling water density, the control by the sheet velocity cannot provide a large temperature difference. Namely, if the sheet velocity is set at a too low level in order to develop a large temperature difference, the clad sheet may be cooled excessively, so that the sheet cannot be completely flattened by the hot leveller. In the case where the clad sheet thickness is small, therefore, the control should be done mainly by the control of the water density.

As will be understood from the foregoing description, according to the fourth and the fifth embodiments of the invention, it is possible to obtain a flat clad sheet having no camber after the cooling, regardless of the factors such as the sheet thickness, clad ratio, material of the covering layer and the temperature at which the levelling is commenced. This in turn eliminates the necessity for the cold levelling which heretofore has been necessarily employed following the hot levelling, for all types of two-layered clad steel sheet.

It will be understood by those skilled in the art that the described fourth and fifth embodiments are theoretically applicable not only to the described clad steel sheet but also to any types of two-layered clad metal sheet having various combinations of metals of different thermal expansion coefficients.

[Fourth Embodiment]

The sixth levelling method in accordance with the invention will be described hereinunder.

Figure 13:
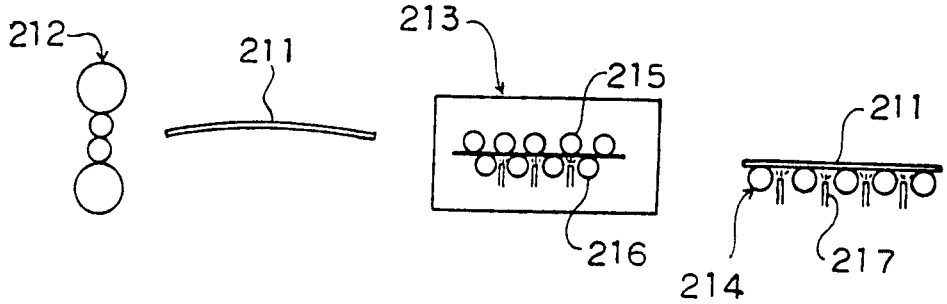
FIG. 13 is a view showing general arrangement of the production line of a two-layered clad metal sheet to which the levelling method in accordance with the sixth embodiment is applied.

FIG. 13 shows general arrangement of a production line for producing a two-layered clad metal sheet, e.g., a two-layered clad steel sheet 211, to which the sixth embodiment of the levelling method in accordance with the invention is applied. The two-layered clad steel sheet 211 is composed of a base layer and a covering layer. For instance, the base layer is constituted by a carbon steel which exhibits a comparatively small amount of thermal contraction, while the covering layer is constituted by a stainless steel which exhibits a comparatively large amount of thermal contraction. The clad steel sheet 211 is rolled by a rolling mill 212, hot-levelled by a hot leveller 213 and then conveyed by table rollers 214 to the next step of a production process.

Figure 14:
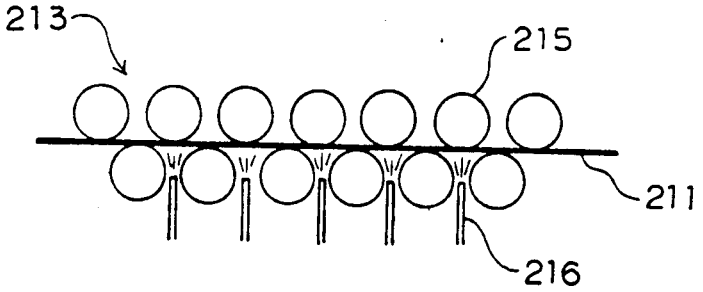
FIG. 14 is a schematic illustration of the state of cooling of a clad sheet under the hot levelling conducted in accordance with the sixth embodiment of the invention.
Figure 15:
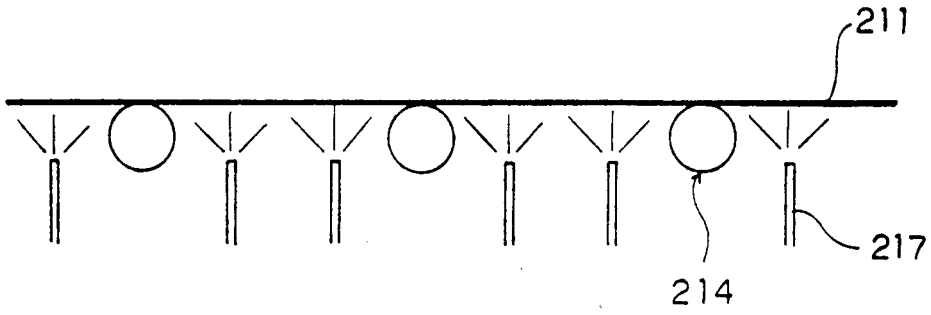
FIG. 15 is a schematic illustration of the state of cooling of a clad sheet which is being conveyed by a table roller in the sixth embodiment of the invention.
Figure 16:
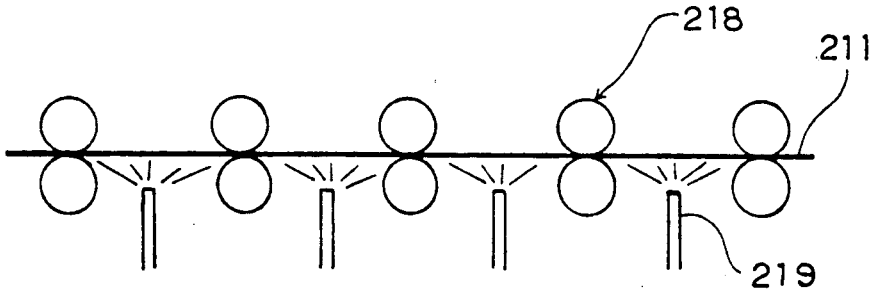
FIG. 16 is a schematic illustration of the state of cooling of the clad sheet passing through the nip of pinch rollers in the sixth embodiment of the invention.

As will be seen from FIG. 14, the hot leveller 213 has hot leveller rolls 215 arranged on the upper and lower sides of the path of the clad sheet 211, and a plurality of cooling headers 216 arranged between adjacent lower leveller rolls 215. The layer which exhibits the greater amount of thermal contraction, i.e., the covering layer of the stainless steel, is directed downwardly, and the cooling headers 216 are arranged to face this layer, so as to forcibly cool the covering layer of the clad steel sheet 211 during the hot levelling through the hot leveller rolls 215, thereby developing between the base layer and the covering layer a temperature difference which is necessary for restraining the camber of the clad steel which may otherwise appear when the clad steel sheet 211 is cooled to the room temperature. As will be seen from FIG. 15, a plurality of table rollers 214 are disposed at the outlet side of the hot leveller 213, and cooling headers 217 are disposed between adjacent table rollers 214.

The cooling headers 217 are so arranged as to further cool the covering layer of the clad steel sheet 211 immediately after the hot levelling, thereby suppressing the tendency of such a breadthwise camber that the covering layer constitutes the outer side, as a result of transfer of the heat to the covering layer from the base layer which is not cooled forcibly in the hot leveller 213.

In this embodiment, the covering layer of the clad steel sheet 211 immediately after the hot levelling by the hot leveller 213 is forcibly cooled so as to realize a greater amount of thermal contraction in the covering layer than in the base layer, thereby preventing such a camber of the clad steel sheet that the covering layer constitutes the outer side which may otherwise appear immediately after the hot levelling.

The arrangement of this embodiment may be modified in such a manner that pinch rolls 218 are arrangd at the outlet side of the hot leveller 213 and cooling headers 219 in place of the cooling headers 217 mentioned above are disposed between the adjacent rollers of the pinch roll 218. Thus, in this embodiment, the hot-levelled clad sheet 211 is subjected to an additional forcible cooling in which the clad sheet is cooled at its one side while it is being restrained by the rollers of the pinch roll 218 or, alternatively, the additional forcible cooling is effected on one side of the hot-levelled clad sheet 211 while the latter is being conveyed by table rollers without being restrained in such a manner as to develop a large temperature difference between the upper and lower surfaces of the hot levelled clad steel sheet 211. This additional forcible cooling generates a thermal stress in the hot-levelled clad sheet 211, which in turn produces a compressive plastic deformation in the base layer which has a lower yield stress, whereby the amount of camber of the clad steel sheet at the room temperature is reduced.

The additional forcible cooling on one side of the clad steel sheet by the cooling headers 217 or 219 after the hot levelling need not be conducted for a long time. Namely, the additional forcible cooling may be terminated when the camber after the hot levelling has been reduced to a level of about 100 mm which does not substantially hinder the convey of the clad steel sheet after the hot levelling. In addition, the plastic deformation in the clad steel sheet takes place only when the material exhibits a low yield stress, i.e., only when the material temperature is high. For these reasons, the additional forcible cooling may be finished only in a short period of time.

The extent of the forcible cooling conducted during the hot levelling may be such that it can develop a temperature difference which is large enough to materially prevent the final camber when the clad steel sheet is cooled down to the room temperature. The extent of the forcible cooling conducted after the hot levelling also may be such that it can materially reduce the negative camber after the hot levelling. The method of the described embodiment, therefore, may be modified such that the forcible cooling is effected on both sides of the clad steel sheet at different rates or cooling power levels.

Although two-layered clad steel sheet is mentioned specifically, it will be clear to those skilled in the art that the described embodiment is applicable to various two-layered clad metal sheet composed of different metals having different values of thermal expansion coefficient.

A practical example of this embodiment will be explained hereinunder. Clad steel sheets having a covering layer of stainless steel, having a total thickness of 20 mm, breadth of 3000 mm and clad ratio of 30%, were levelled by three types of levelling method: namely, a conventional method I in which no forcible cooling was effected, a conventional method II in which one-side cooling was effected only during the hot levelling, and a method of the embodiment in which the one-side cooling was effected both during and after the hot levelling. The results of the test hot levelling were as follows.

Figure 17:
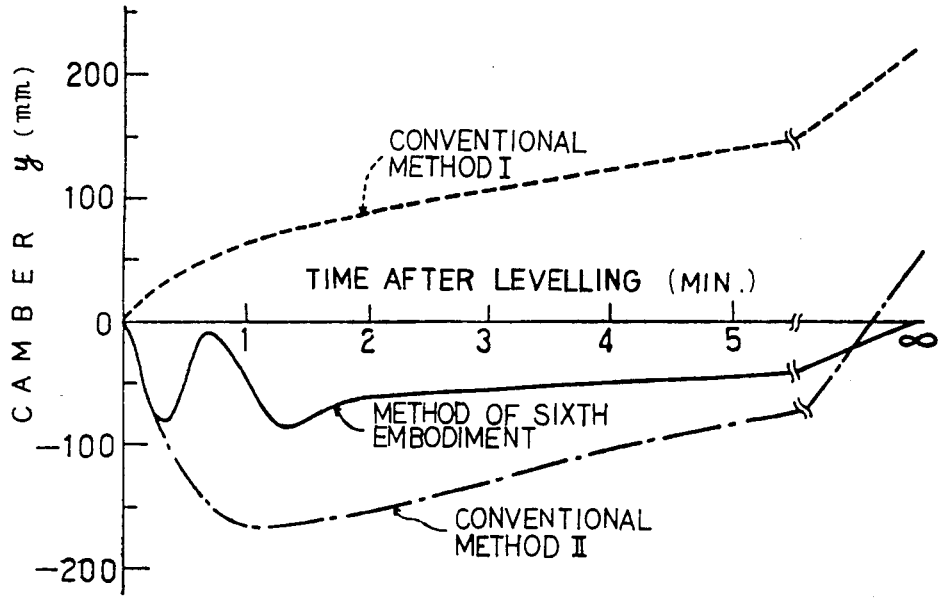
FIG. 17 is a diagram showing the change with time in the amount of camber as observed in a clad steel sheet having a stainless steel covering layer, when the sheet is processed in accordance with the sixth embodiment.
Figure 18:
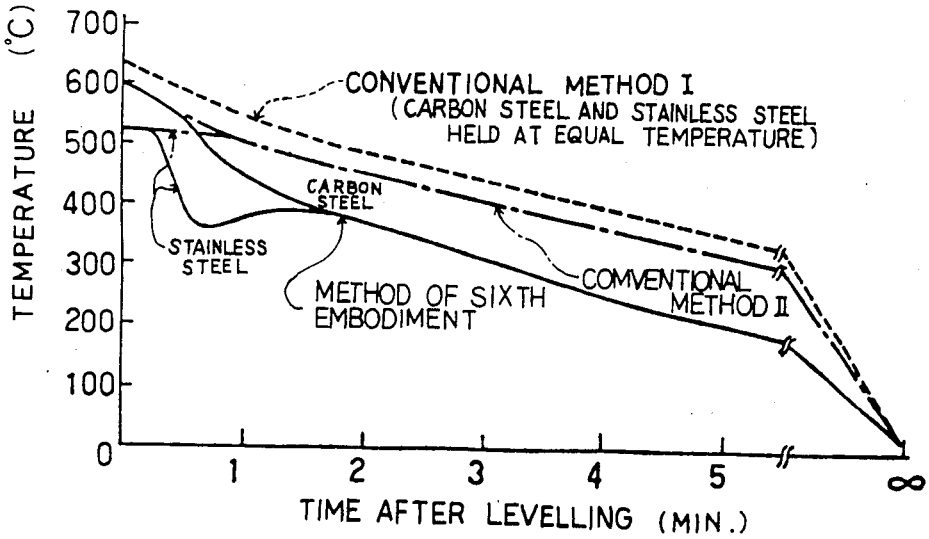
FIG. 18 is a diagram showing the changes in the temperature of the upper and lower surfaces of the clad sheet having stainless steel covering layer, when the clad sheet is processed in accordance with the sixth embodiment of the invention.

In the conventional method II and in the method of the embodiment, the clad steel sheets composed of a base layer of a carbon steel and a covering layer of a stainless steel were hot-levelled the following way. During the hot levelling, cooling water was sprayed onto the covering layer of the clad steel sheet so as to cool the stainless steel constituting the covering layer, by means of water spraying heads disposed between adjacent hot leveller rollers. The temperature of the clad steel sheet was 650° C. at the inlet side of the hot leveller. The temperatures of the stainless steel covering layer on the lower side of the clad steel sheet and the carbon steel constituting the base layer on the upper side of the clad steel sheet were 520° C. and 600° C., respectively, immediately after the hot levelling. In the method of the embodiment of the invention, a further cooling was effected on the clad steel sheet after the hot levelling. This additional forcible cooling was commenced at a moment 15 seconds after the completion of the hot levelling, and was maintained for 20 seconds thereafter. The additional cooling was effected by applying cooling water to the covering layer of the stainless steel by cooling water spray headers disposed between adjacent table rollers which are arranged at the outlet side of the hot leveller. In contrast, in the cnventional method I, the hot levelling was completed at a uniform temperature of 630° C., without employing the one-side cooling by water. FIG. 17 shows the change in the amounts of camber observed after the hot levelling, while FIG. 18 shows the changes in the temperatures of the base layer of the carbon steel and the covering layer of the stainless steel. In the clad steel sheet after the hot levelling by the conventional method I, the covering layer of the stainless steel showed a greater thermal contraction than the base layer of the carbon steel because both layers are maintained at the same high temperature during the hot levelling and then air-cooled. In this clad steel sheet, therefore, a large camber of 240 mm was left after the cooling to the room temperature.

In the case of the clad steel sheet hot levelled by the conventional method II, the temperature difference maintained during the hot levelling was uniformalized in a short time after the hot levelling, so that the base layer of the carbon steel exhibited greater thermal contraction than the covering layer of the stainless steel, resulting in a negative camber of −170 mm. However, as the clad steel sheet is further air-cooled, the camber was gradually decreased due to greater thermal contraction exhibited by the base layer of the stainless steel, and only a small camber of 50 mm was left finally after the cooling down to the room temperature. In contrast, in the clad steel sheet treated in accordance with the method of the embodiment, the camber after the hot levelling did not exceed −80 mm, thanks to the one-side cooling by water after the hot levelling. In addition, the amount of camber finally left in the clad steel sheet after cooling down to the room temperature was substantially zero.

As has been described, according to the sixth embodiment of the invention, the layer which makes greater thermal contraction is forcibly cooled not only during the hot levelling but also after the hot levelling. It is, therefore, possible to suppress the generation of a negative camber which may otherwise appear after the hot levelling, thereby facilitating the convey of the two-layered clad metal sheet after the hot levelling, and to minimize the final camber after the cooling down to the room temperature. This also reduces the load during a cold levelling. In consequence, the hot levelling method of the sixth embodiment greatly contributes to the improvement in the efficiency of production of the clad metal sheets of the kind described.

[Fifth Embodiment]

The seventh levelling method in accordance with the invention will be described hereinunder.

Figure 19:
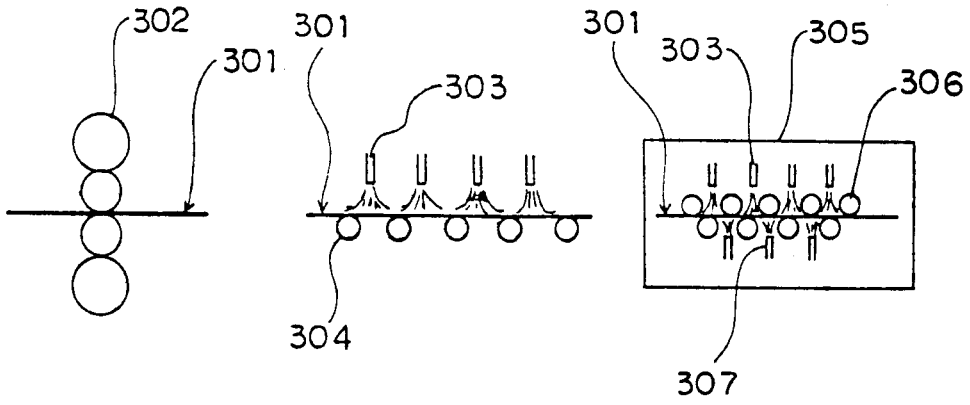
FIG. 19 shows a general arrangement of a production line for producing a two-layered clad metal sheet to which the seventh embodiment of the levelling method of the invention is applied.
Figure 20:
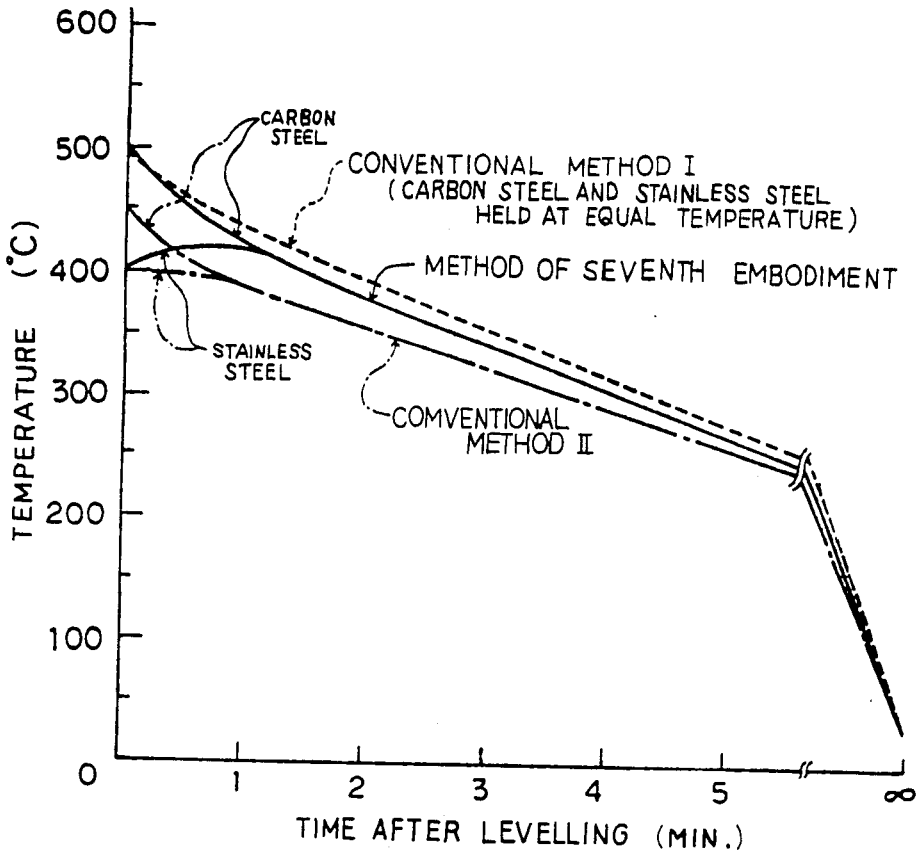
FIG. 20 is a diagram showing the change in the temperatures at the upper and lower surfaces of the clad steel sheet having stainless steel covering layer processed in accordance with the seventh embodiment of the invention.

FIG. 19 shows general arrangement of a production line for producing a two-layered clad metal sheet, e.g., a two-layered clad steel sheet 301, to which the levelling method of the seventh embodiment is applied. The two-layered clad steel sheet 301 is composed of a base layer and a covering layer. For instance, the base layer is made of a cabon steel which makes a comparatively small thermal contraction, while the covering layer is made of a stainless steel which exhibits a comparatively large thermal contraction. With the base layer and the covering layer directed upwardly and downwardly, respectively, the clad steel sheet 301 is rolled by a rolling mill 302 and conveyed by table rollers 304 while the base layer thereof is heated by burners 303. The clad steel sheet 301 is then levelled by a hot leveller 305 and sent to a next step of the process. The hot leveller 305 has upper and lower hot leveller rolls 306, burners 303 disposed between adjacent upper hot leveller rolls 306 and cooling spray nozzles 307 disposed between adjacent lower hot leveller rolls 306. The heating of the base layer of the clad steel sheet conducted by the burners 303 before and during the hot levelling is intended for maintaining the yield stress of the base layer at a low level during the hot levelling, and for maintaining a sufficiently large temperature difference between the base layer and the covering layer. On the other hand, the forcible cooling by the cooling spray nozzles 304 during the hot levelling is conducted for the purpose of developing a large temperature difference between the base layer and the covering layer of the clad steel sheet 301.

The heating which is effected on the layer of smaller thermal contraction may be conducted by any one of the following three modes: (1) to effect the heating both before and during the hot levelling; (2) to effect the heating only before the hot levelling; and (3) to effect the heating only during the hot levelling.

On the other hand, the forcible cooling effected on the layer of greater thermal contraction may be conducted either by (1) applying the cooling water both before and during the hot levelling or (2) applying the cooling water only during the hot levelling.

A practical example of this embodiment will be explained hereinunder.

Clad steel sheets having a covering layer of a stainless steel, having a tickness of 20 mm, breadth of 3000 mm and a clad ratio of 30%, were finished by the finish rolling stand of the rolling mill, at a comparatively low temperature of 800° C. The clad steel sheets were then subjected to different types of hot levelling: namely, a conventional method I in which no heating nor cooling is effected before and during the hot levelling, a conventional method II in which the covering layer of the stainless steel is forcibly cooled only during the hot levelling, and a method of the invention in which, before the hot levelling, only the heating of the base layer by the burners is conducted and, during the hot levelling, both the heating of the base layer by the burners and the cooling of the covering layer by the water spray nozzles are conducted. In all cases, the temperatures of the base layer of the carbon steel and the covering layer of the stainless steel were substantially equal. Namely, in the case of the conventional methods I and II, the temepratures of the base layer and the covering layer were 550° C., while, in the case of the method of the embodiment, the temperatures were 580° C. As to the temperature at the outlet side of the hot leveller, the clad steel sheet treated by the conventional method I showed an equal temperature of 500° C. both at the base and covering layers thereof, whereas, in the clad steel sheet treated in accordance with the conventional method II, the base and covering layers showed temperatures of 450° C. and 400° C., respectively. On the other hand, the clad steel sheet treated by the method of the embodiment showed temperatures of 510° C. and 410° C., respectively, at its base and covering layers.

Figure 21:
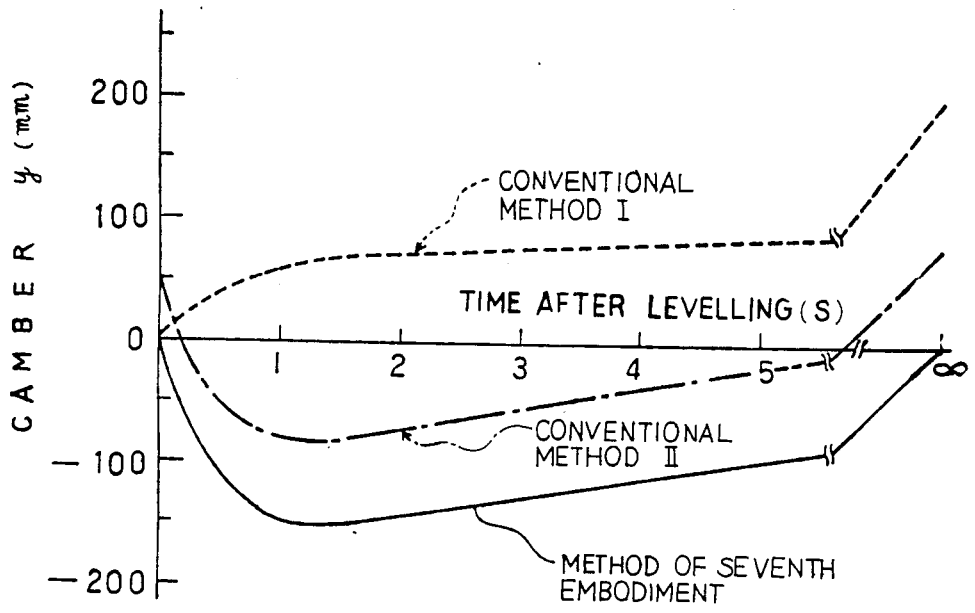
FIG. 21 is a diagram showing the change in the amount of camber of the clad steel sheet having a stainless steel covering layer processed in accordance with the seventh embodiment.
Figure 22:
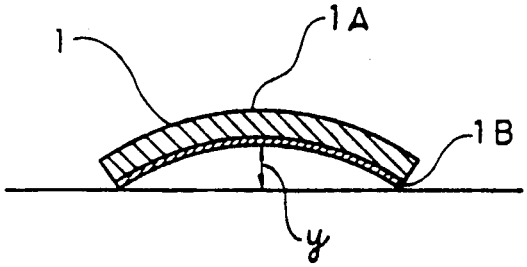
FIG. 22 is a sectional view of a two-layered clad metal sheet.
Figure 23:
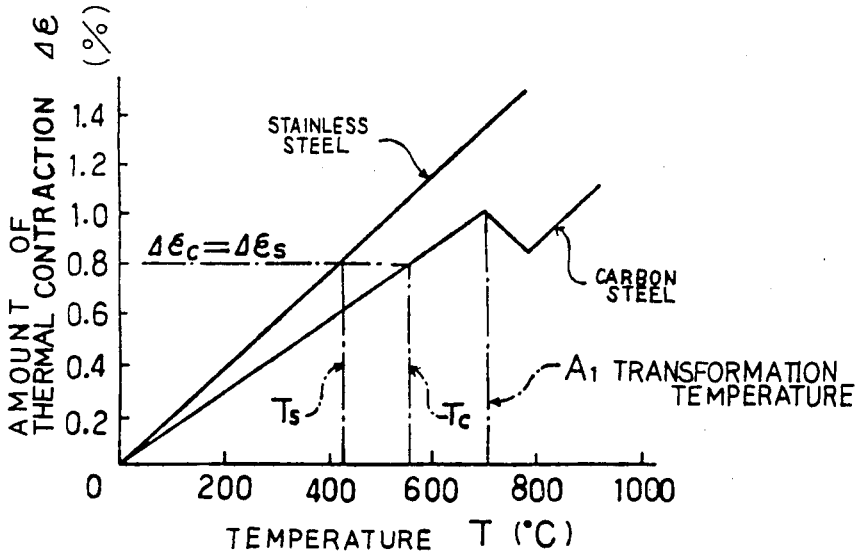
FIG. 23 is a diagram showing the relationship between the temperatures and amounts of thermal contraction of the base layer constituted by a carbon steel and the covering layer constituted by a stainless steel.

FIG. 21 shows the changes in the temperatures of the base layer of the carbon steel and the covering layer of the stainless steel in relation to time after the hot levelling, for each of the clad steel sheets treated by these three different methods, while FIG. 21 shows changes in the amounts of camber in these clad steel sheets after the hot levelling.

The clad steel sheet treated by the conventional method I exhibited a flat shape immediately after the hot levelling. However, since the hot levelling is effected while both sides of the clad steel sheet are maintained at the same temperature, the covering layer of the stainless steel exhibits a greater thermal contraction than the base layer of the carbon steel during the cooling, thus leaving a large final camber of 200 mm after cooling down to the room temperature.

The clad steel sheet treated by the conventional method II was not completely flattened by the hot leveller and exhibited a camber of 50 mm immediately after the hot levelling. However, the camber was changed into negative camber of −80 mm as a result of the temperature uniformalization. Thereafter, the camber was gradually decreased as the cooling further proceeds, due to the greater amount of thermal contraction exhibited by the covering layer of the stainless steel. Finally, a positive camber of 80 mm was left in the clad steel sheet after cooling down to the room temperature.

In contrast, the clad steel sheet treated in accordance with the method of the embodiment was flat in the state immediately after the hot rolling. Then, as the cooling proceeds, the clad steel sheet exhibited a negative camber of −150 mm, but the final camber after the cooling down to the room temperature was substantially zero.

Thus, according to the seventh embodiment of the invention, it is possible to restrain the generation of the final camber in the two-layered clad metal sheet after cooling down to the room temperature, even if the final rolling temperature of the clad metal sheet and the interval between the rolling and the hot levelling are changed. This in turn reduces the load of a cold levelling.

As has been described, according to the seventh embodiment of the levelling method of the invention, the hot levelling is conducted while the layer of smaller thermal contraction and the layer of the greater thermal contraction are forcibly heated and cooled, respectively. By this method, it is possible to reduce the yield stress of the base layer during the hot levelling, thus obtaining a flat state of the clad metal sheet immediately after the hot levelling, while developing a sufficiently large temperature difference between the base layer and the covering layer, whereby the generation of substantial camber in the clad metal sheet after cooling down to the room temperature is avoided without fail.

We claim:

1. A method for preventing camber of a two-layered metal clad sheet having a base layer and a covering layer of different metals with different coefficients of thermal contraction, said method comprising: developing a temperature difference $\Delta T$ between said base layer and said covering layer during hot levelling, by providing a greater cooling effect before or during levelling to one layer with greater thermal contraction than to an other layer with a smaller thermal contraction, said temperature difference $\Delta T$ being expressed by a formula as follows:

$$\Delta T = f(\Delta\alpha, \overline{\alpha}, a, To)$$

where, $\Delta\alpha$: a difference in a coefficient of thermal expansion between both metals a: a clad ratio (ratio covering layer layer thickness to total sheet thickness)

To: hot leveller inlet temperature (°C.)

$\overline{\alpha}$: mean of a coefficient of thermal expansion of both metals.

2. A method for preventing camber of a two-layered metal clad sheet having a base layer and a covering layer of different metals with different coefficients of thermal contraction, wherein a greater cooling effect is imparted to one layer with a greater thermal contraction than to an other layer with a smaller thermal contraction by means of upper and lower surface water-cooling means before and during hot levelling, said method comprising: computing a temperature difference during the levelling between upper and lower surfaces of said metal clad sheet necessary for preventing a final camber of said metal clad sheet when said sheet is cooled to room temperature; and controlling a density of cooling water applied by said water-cooling means and velocity at which said metal clad sheet passes through the hot leveller, such that an actual temperature difference measured by upper and lower surface thermometers disposed in said hot leveller coincides with the computed temperature difference.

3. A method for preventing camber of a two-layered metal clad sheet having a base layer and a covering layer of different metals with different coefficients of thermal contraction, wherein a greater cooling effect is imparted to one layer with greater thermal contraction than to an other layer with a smaller thermal contraction by means of upper and lower surface water-cooling means before or during hot levelling, said method comprising: computing a temperature difference during levelling between upper and lower surfaces of said metal clad sheet necessary for preventing final camber of said metal clad sheet when said sheet is cooled to room temperature; and controlling a difference in a density of cooling water between said upper and lower surfaces with said water cooling means and a velocity at which said metal clad sheet passes through the hot leveller, such that an actual temperature difference measured by upper and lower surface thermometers disposed in said hot leveller coincides with the computed temperature difference; predicting an expected final amount of camber at said room temperature from information obtained from said metal clad sheet at an outlet of said hot leveller after a uniformalization of the temperature; correcting the computation of a temperature difference of a next metal clad sheet in accordance with the predicted final amount of camber.

4. A method for preventing camber of a two-layered metal clad sheet having a base layer and a covering layer of different metals with different coefficients of thermal contraction, wherein a greater cooling effect is imparted to one layer with a greater thermal contraction than to an other layer with a smaller thermal contraction by means of upper and lower surface water-cooling means before or during hot levelling, said method comprising: setting a difference in a density of cooling water between said upper and lower surface with said water-cooling means and a velocity of said sheet in the hot leveller which are necessary for preventing final camber of said metal clad sheet when said sheet is cooled to room temperature; and controlling said upper and lower surface water-cooling means and the sheet velocity in accordance with the set values.

5. A method for preventing camber of a two-layered metal clad sheet having a base layer and a covering layer of different metals with different coefficients of thermal contraction, wherein a greater cooling effect is imparted to one layer with a greater thermal contraction than an other layer with a smaller thermal contraction by means of upper and lower surface water-cooling means before or during hot levelling, said method comprising: setting a difference in a density of cooling water between said upper and lower surfaces with said water-cooling means and a velocity of said sheet in the hot leveller which are necessary for preventing final camber of said metal clad sheet when said sheet is cooled to room temperature; controlling said upper and lower surface water-cooling means and the sheet velocity in accordance with the set values; predicting an expected final amount of camber at said room temperature from information obtained from said metal clad sheet at an outlet of said hot leveller after a uniformalization of the temperature; correcting the computation of the density of the cooling water and the sheet velocity of a next metal clad sheet in accordance with the predicted final amount of camber.

6. A method for preventing camber of a two-layered metal clad sheet composed of a base layer and a covering layer of different metals having different coefficients of thermal expansion, the method comprising: forcibly cooling, before or during hot levelling, one layer with a greater thermal contraction so as to create a predetermined temperature difference during the levelling between upper and lower surfaces of said metal clad sheet; and further forcibly cooling, after said levelling, said layer so as to decrease a negative camber which occurs due to a uniformalization of the temperature at an outlet of the leveller.

7. A method for preventing camber of a two-layered metal clad sheet composed of a base layer and a covering layer of different metals having different coefficients of thermal expansion, the method comprising: heating one layer with a smaller thermal contraction before or during hot levelling, while forcibly cooling an other layer with a greater thermal contraction before or during said hot levelling so as to create a predetermined temperature difference between upper and lower surfaces of said metal clad sheet during said hot levelling.

* * * * *